US011554310B2

(12) United States Patent
Dubois et al.

(10) Patent No.: US 11,554,310 B2
(45) Date of Patent: Jan. 17, 2023

(54) SKATE FOR A HOCKEY GOALKEEPER

(71) Applicant: BAUER HOCKEY LLC, Exeter, NH (US)

(72) Inventors: Sebastien Dubois, Piedmont (CA); Charles-Antoine Desrochers, Prevost (CA); Alexandre Leblanc, Mascouche (CA); Guillaume Harvey, Montreal (CA); Alexis Seguin, Laval (CA)

(73) Assignee: BAUER HOCKEY, LLC, Exeter, NH (US)

( * ) Notice: Subject to any disclaimer, the term of this patent is extended or adjusted under 35 U.S.C. 154(b) by 72 days.

(21) Appl. No.: 16/871,787

(22) Filed: May 11, 2020

(65) Prior Publication Data

US 2020/0338433 A1 Oct. 29, 2020

Related U.S. Application Data

(63) Continuation of application No. 15/270,756, filed on Sep. 20, 2016, now Pat. No. 10,668,358.

(60) Provisional application No. 62/221,064, filed on Sep. 20, 2015.

(51) Int. Cl.
*A63C 1/30* (2006.01)
*A63C 1/00* (2006.01)

(52) U.S. Cl.
CPC ..... *A63C 1/303* (2013.01); *A63C 1/00* (2013.01)

(58) Field of Classification Search
CPC ..... A63C 1/30–34
See application file for complete search history.

(56) References Cited

U.S. PATENT DOCUMENTS 4,509,276 A * 4/1985 Bourque ..... A43B 5/1683 12/142 R
D305,560 S 1/1990 Hoshizaki et al.
4,995,174 A 2/1991 Hong et al.
D316,772 S 5/1991 Rose
5,248,156 A * 9/1993 Cann ..... A63C 17/18 280/11.18
5,360,227 A * 11/1994 Lemelson ..... F01L 3/04 280/610
5,388,845 A * 2/1995 Soo ..... A63C 1/32 280/11.17
5,456,495 A * 10/1995 McLeod ..... A63C 1/00 280/11.12
5,484,148 A * 1/1996 Olivieri ..... A63C 1/30 280/11.18
D369,515 S 5/1996 Higgins
5,641,169 A * 6/1997 Bekessy ..... A63C 1/30 280/11.18
5,826,890 A * 10/1998 Swande ..... A63C 1/32 280/11.18

(Continued)

OTHER PUBLICATIONS

Canadian Office Action for 2,919,599 to Bauer Hockey Ltd., dated Dec. 29, 2021, 5 Pages.

(Continued)

*Primary Examiner* — Erez Gurari

(57) ABSTRACT

A goalie skate for a hockey goalkeeper. The goalie skate may comprise a skate boot for receiving a foot of the hockey goalkeeper, a blade for contacting ice, and a blade holder between the skate boot and the blade. The skate boot comprises an outer shell comprising a synthetic material. The goalie skate may be cowlingless.

24 Claims, 27 Drawing Sheets

(56) References Cited

U.S. PATENT DOCUMENTS

D402,327 S 12/1998 Aird et al.
D410,136 S 5/1999 Lefebvre et al.
D414,017 S 9/1999 Lefebvre
D414,916 S * 10/1999 Rench ..... D2/904
5,988,683 A 11/1999 Venier et al.
D422,044 S 3/2000 Peterson
D424,149 S 5/2000 Graf et al.
6,164,667 A * 12/2000 Olivieri ..... A63C 1/32 280/11.18
D439,297 S 3/2001 Mayer et al.
6,223,457 B1 * 5/2001 Graf ..... A43C 13/14 36/77 R
6,293,565 B1 * 9/2001 Bouchard ..... A63C 17/06 280/11.222
6,295,679 B1 * 10/2001 Chenevert ..... A43B 5/1666 280/11.221
6,364,321 B1 * 4/2002 Steinhauser, Jr. ..... A63C 1/32 280/11.18
6,367,170 B1 4/2002 Williams
6,421,934 B2 * 7/2002 Graf ..... A63C 3/00 36/115
6,467,778 B1 * 10/2002 Goldsmith ..... A63C 1/22 280/11.18
6,505,422 B2 1/2003 Racine
D493,275 S 7/2004 Koyess et al.
D494,747 S 8/2004 Langevin et al.
6,851,682 B2 * 2/2005 Durocher ..... A43B 5/1658 36/117.3
D512,476 S 12/2005 Howard
D531,691 S 11/2006 Murphy et al.
7,243,924 B2 7/2007 Dahlo et al.
D579,510 S 10/2008 Howard et al.
D579,999 S 11/2008 Howard et al.
D616,182 S 5/2010 Nelson
7,758,053 B2 * 7/2010 Wylie ..... A63C 1/32 280/11.18
7,793,947 B2 9/2010 Labonte
7,896,363 B2 * 3/2011 Lovejoy ..... A43B 7/1495 280/11.18
7,950,676 B2 5/2011 Goldsmith et al.
D654,260 S 2/2012 Frappier et al.
D657,545 S 4/2012 Frappier et al.
8,353,535 B2 1/2013 Salmon et al.
8,387,286 B2 * 3/2013 Koyess ..... A43B 23/0255 36/88
8,453,350 B2 6/2013 Yang
8,857,823 B2 * 10/2014 Mars ..... A63C 1/28 280/11.15
D769,387 S 10/2016 Morin
9,554,615 B2 1/2017 Labonte
D784,665 S 4/2017 Yeh
D787,788 S 5/2017 Nelson
9,693,600 B1 * 7/2017 Van Horne ..... B29D 35/02
10,039,341 B2 8/2018 Faucher et al.
D831,314 S 10/2018 Yeh
D854,175 S 7/2019 Pryor
10,376,771 B2 8/2019 Rouzier et al.
D886,423 S 6/2020 Yeh
10,668,358 B2 6/2020 Dubois et al.
10,743,622 B2 8/2020 Yeh
2001/0022434 A1 * 9/2001 Sauter ..... A43B 5/0466 280/11.221
2002/0175481 A1 * 11/2002 Steinhauser, Jr. ..... A63C 1/32 280/11.18
2002/0190487 A1 * 12/2002 Blankenburg ..... A63C 1/16 280/11.12
2003/0015848 A1 * 1/2003 Pham ..... A63C 1/32 280/11.12
2003/0075884 A1 * 4/2003 Bussiere ..... A43B 5/1666 280/11.12
2005/0097784 A1 * 5/2005 Campolo ..... A43B 5/001 36/134
2006/0108751 A1 * 5/2006 Labonte ..... A63C 1/22 280/11.18
2006/0181035 A1 * 8/2006 Labonte ..... A43B 5/1666 280/11.12
2009/0224525 A1 * 9/2009 Goor ..... A63B 71/1225 280/811
2010/0109312 A1 * 5/2010 Salmon ..... A63C 1/303 280/841
2010/0194062 A1 * 8/2010 Hauser ..... A63C 1/32 280/11.18
2011/0169232 A1 * 7/2011 Tatomir ..... A63C 1/303 280/11.18
2012/0056390 A1 * 3/2012 Zampieri ..... A63C 17/226 280/11.222
2013/0038031 A1 * 2/2013 Cruikshank ..... A63C 1/42 280/11.18
2013/0175771 A1 * 7/2013 Shepley ..... A63C 1/06 280/11.221
2013/0269209 A1 * 10/2013 Lang ..... A43B 23/0205 12/146 C
2013/0285338 A1 * 10/2013 Blois ..... A63C 1/30 29/446
2014/0097583 A1 * 4/2014 Vaughn ..... A63C 1/42 280/11.12
2014/0252736 A1 * 9/2014 Lefebvre ..... B29D 35/04 280/11.12
2015/0097347 A1 * 4/2015 Smirman ..... A63C 1/30 280/11.15
2016/0114239 A1 * 4/2016 Davis ..... A63C 1/303 280/11.12
2016/0143394 A1 * 5/2016 Ikenaka ..... D04B 1/22 66/170
2016/0206947 A1 * 7/2016 Yu ..... F21V 33/0008
2016/0286898 A1 * 10/2016 Manz ..... A43B 23/0245
2017/0080323 A1 * 3/2017 Dubois ..... A43B 5/1691
2020/0359734 A1 11/2020 Champagne et al.
2021/0401109 A1 12/2021 Labonte et al.

OTHER PUBLICATIONS

Examiner's report dated Mar. 13, 2018 in connection with Canadian Design Application No. 179,857, 1 page.
Examiner's report dated Mar. 13, 2018 in connection with Canadian Design Application No. 179,858, 1 page.
Examiner's report dated Mar. 13, 2018 in connection with Canadian Design Application No. 179,859, 1 page.
Examiner's report dated Mar. 5, 2018 in connection with Canadian Design application No. 166,038, 1 page.
Examiner's report dated May 12, 2017 in connection with Canadian Design application No. 166,038, 3 pages.
Final Office Action issued by the USPTO in connection with design U.S. Appl. No. 29/551,288 dated Jan. 25, 2019, 9 pages.
Final Office Action dated Apr. 12, 2017 in connection with U.S. Appl. No. 15/270,756, 16 pages.
Final Office Action dated Feb. 21, 2019 in connection with U.S. Appl. No. 15/270,756, 15 pages.
Non-Final Office Action dated Mar. 26, 2018 in connection with design U.S. Appl. No. 29/551,288, 10 pages.
Non-Final Office Action dated May 1, 2017 in connection with U.S. Appl. No. 15/270,756, 12 pages.
Non-Final Office Action dated May 29, 2018 in connection with U.S. Appl. No. 15/270,756, 14 pages.
Non-Final Office Action dated Oct. 12, 2018 in connection with U.S. Appl. No. 15/270,756, 17 pages.
Advisory Action dated Apr. 12, 2019 in connection with U.S. Appl. No. 29/551,288, 4 pages.
Final Office Action dated Jun. 24, 2019 in connection with U.S. Appl. No. 15/270,753, 20 pages.
Notice of Allowance issued by the USPTO dated Feb. 5, 2020 in connection with U.S. Appl. No. 15/270,756, 23 pages.
Examiner's report dated Nov. 25, 2020 in connection with Canadian Patent Application No. 2,919,599, 4 pages.
JR Mission roller goal skate without cowling HO14, 2014, 2 pages.

(56) References Cited

OTHER PUBLICATIONS

Examiner's report dated Dec. 29, 2021 in connection with Canadian Patent Application No. 2,919,599, 5 pages.
Non-Final Office Action dated Jun. 27, 2022 in connection with design U.S. Appl. No. 29/692,644, 7 pages.

* cited by examiner

SKATE FOR A HOCKEY GOALKEEPER

CROSS-REFERENCE TO RELATED APPLICATIONS

This application is a continuation of and claims the benefit under 35 U.S.C. 120 of U.S. patent application Ser. No. 15/270,756, filed on Sep. 20, 2016 (now U.S. Pat. No. 10,668,358), which claims the benefit under 35 U.S.C. 119(e) of U.S. Provisional Patent Application Ser. No. 62/221,064, filed on Sep. 20, 2015. The contents of the aforementioned applications are incorporated by reference herein.

FIELD

The invention generally relates to equipment for hockey goalkeepers and, more particularly, to skates for hockey goalkeepers.

BACKGROUND

Hockey goalkeepers (a.k.a. goalies) defend their team's goal in a hockey game. To that end, a hockey goalie wears various equipment, including goalie skates to move on a playing surface (e.g., ice), leg pads to protect his/her legs when used to stop a puck or ball and/or when moving (e.g., dropping) them onto the playing surface, and a blocker and a catcher to stop the puck or ball with his/her arms and hands A goalie skate typically comprises a skate boot for receiving a goalie's foot and a cowling that covers toe, heel, lower medial, and lower lateral areas of the skate boot. The cowling is a hard cover that extends over the toe, heel, lower medial, and lower lateral areas of the skate boot for added protection in those areas. The cowling also carries a blade or set of inline wheels of the skate that engages the playing surface.

While the cowling imparts impact protection to the goalie skate, it may detrimentally affect other characteristics of the skate. For instance, a maximal angle of attack of the goalie skate with the playing surface may be limited by the cowling as a medial side of the cowling will contact the playing surface first when the goalie skate is inclined. This can in turn affect how fast and how hard the goalie can push off the playing surface during play.

For these and/or other reasons, there is a need to improve skates for hockey goalies.

SUMMARY

In accordance with an aspect of the invention, there is provided a goalie skate for a hockey goalkeeper. The goalie skate comprises a skate boot for receiving a foot of the hockey goalkeeper, a blade for contacting ice, and a blade holder between the skate boot and the blade. The skate boot comprises an outer shell comprising a synthetic material. The goalie skate is cowlingless.

In accordance with another aspect of the invention, there is provided a goalie skate for a hockey goalkeeper. The goalie skate comprises a skate boot for receiving a foot of the hockey goalkeeper. The skate boot comprises an outer shell comprising a synthetic material. The outer shell comprises a lateral side portion for facing a lateral side of the foot of the hockey goalkeeper, a medial side portion for facing a medial side of the foot of the hockey goalkeeper, and a heel portion for facing a heel of the foot of the hockey goalkeeper. The goalie skate further comprises a blade for contacting ice and a blade holder between the skate boot and the blade. A bottom region of the lateral side portion of the outer shell, a bottom region of the medial side portion of the outer shell, and a bottom region of the heel portion of the outer shell are exposed.

In accordance with another aspect of the invention, there is provided a goalie skate for a hockey goalkeeper. The goalie skate comprises a skate boot for receiving a foot of the hockey goalkeeper. The skate boot comprises an outer shell comprising a synthetic material. The goalie skate further comprises a blade for contacting ice and a blade holder between the skate boot and the blade. The blade holder comprises a blade-detachment mechanism configured to selectively detach and remove the blade from the blade holder and attach the blade to the blade holder. The blade-detachment mechanism comprises an actuator manually operable to detach and remove the blade from the blade holder.

In accordance with another aspect of the invention, there is provided a goalie skate for a hockey goalkeeper. The goalie skate comprises a skate boot for receiving a foot of the hockey goalkeeper, a skating device for contacting a playing surface, and a holder between the skate boot and the skating device. The skate boot comprises an outer shell comprising a synthetic material. The goalie skate is cowlingless.

These and other aspects of the invention will now become apparent to those of ordinary skill in the art upon review of the following description of embodiments of the invention in conjunction with the accompanying drawings.

BRIEF DESCRIPTION OF DRAWINGS

A detailed description of embodiments of the invention is provided below, by way of example only, with reference to drawings annexed hereto, in which.

Figure 1:
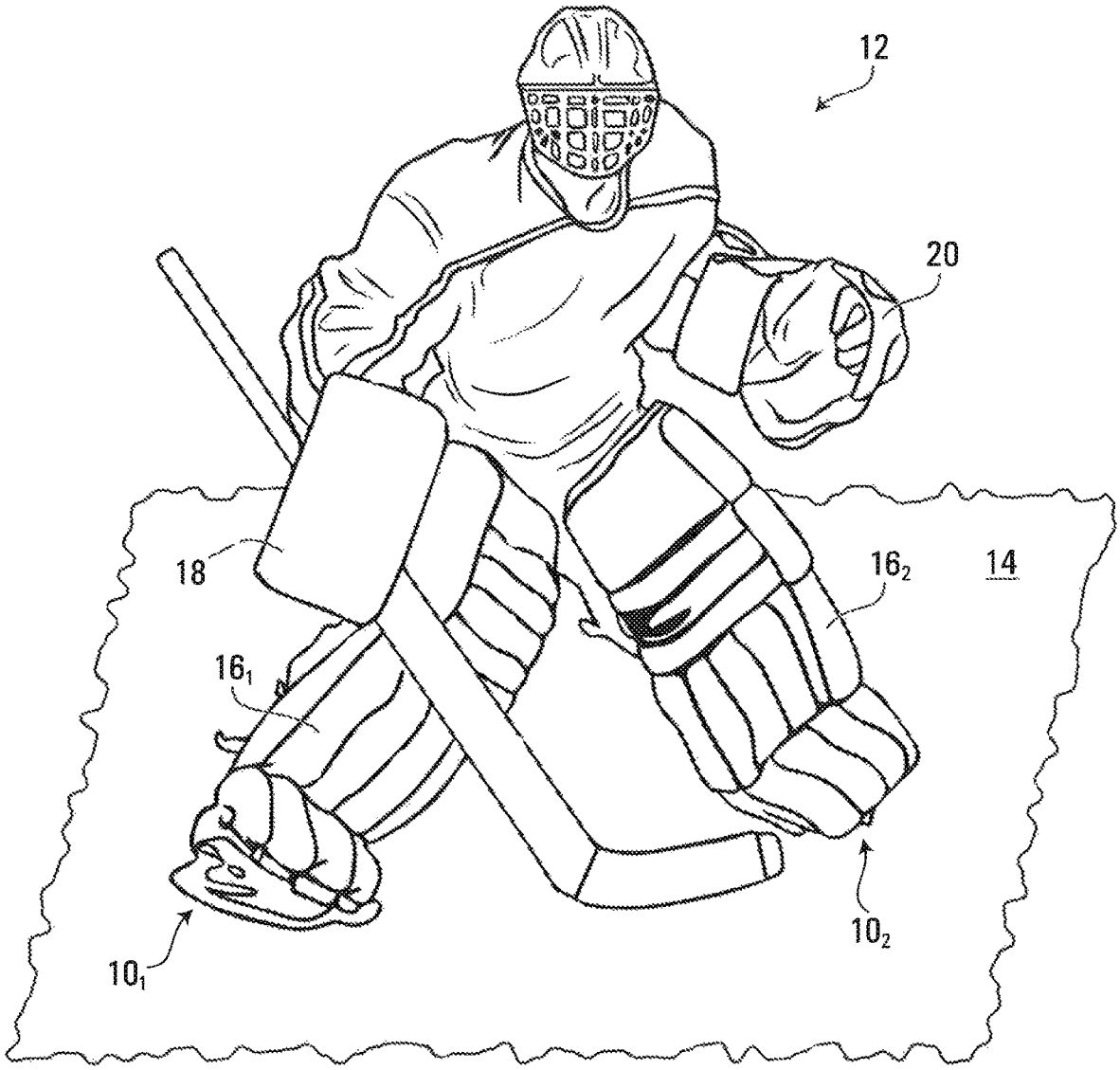
FIG. 1 is an example of a hockey goalkeeper (i.e., goalie) wearing a goalie skate in accordance with an embodiment of the invention.
Figure 2:
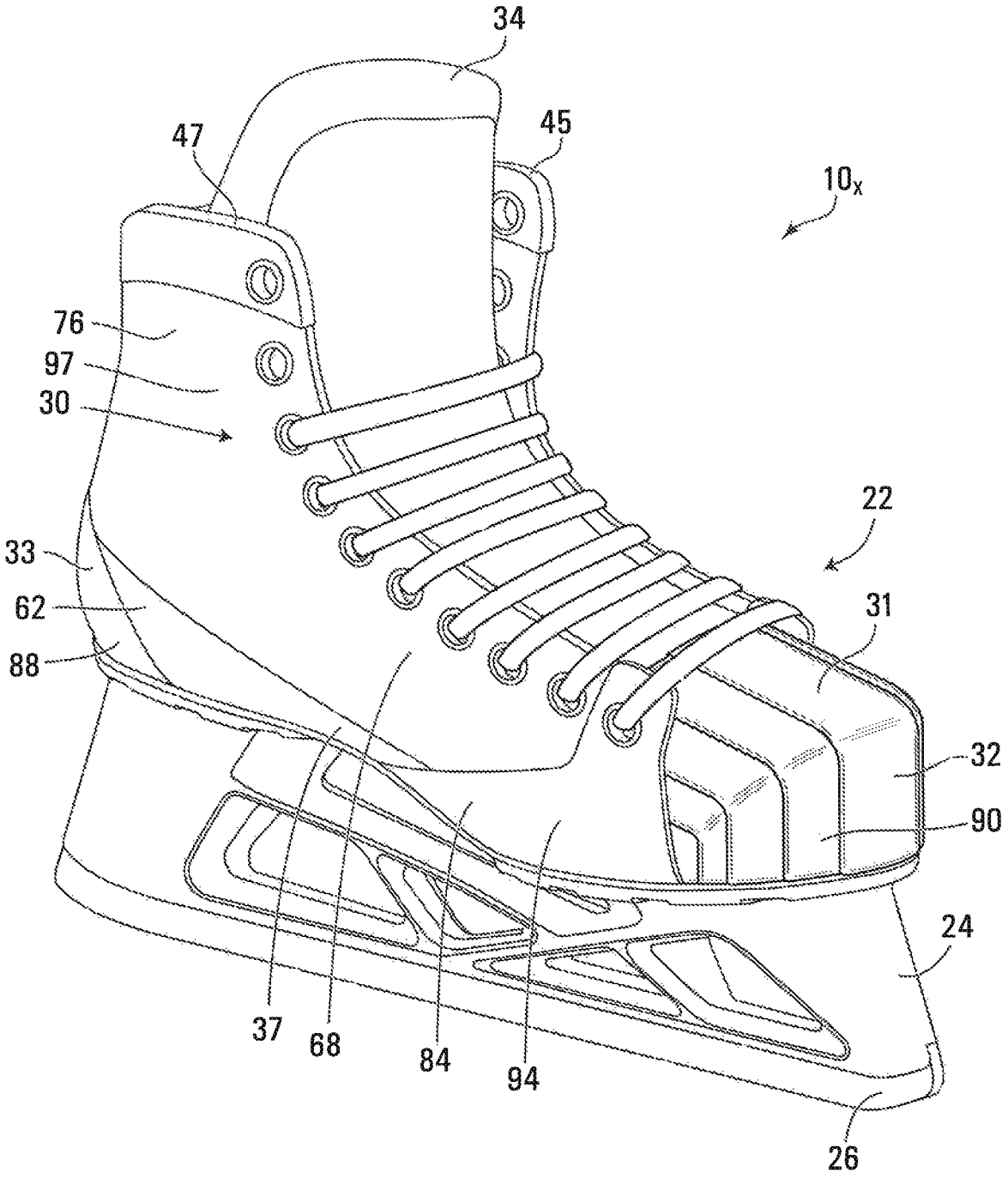
FIGS. 2 and 3 show perspective views of the goalie skate.
Figure 3:
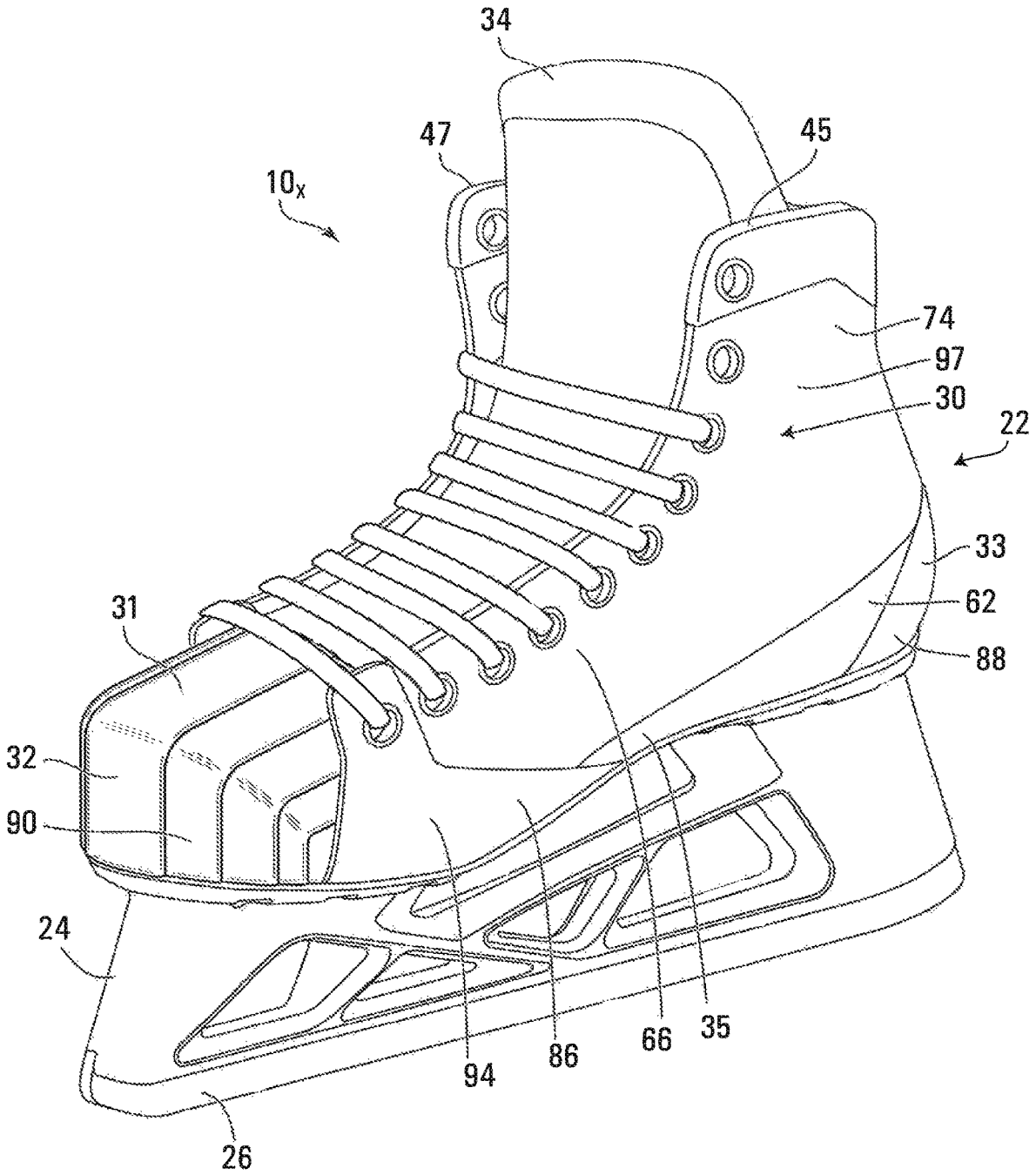
Figure 4:
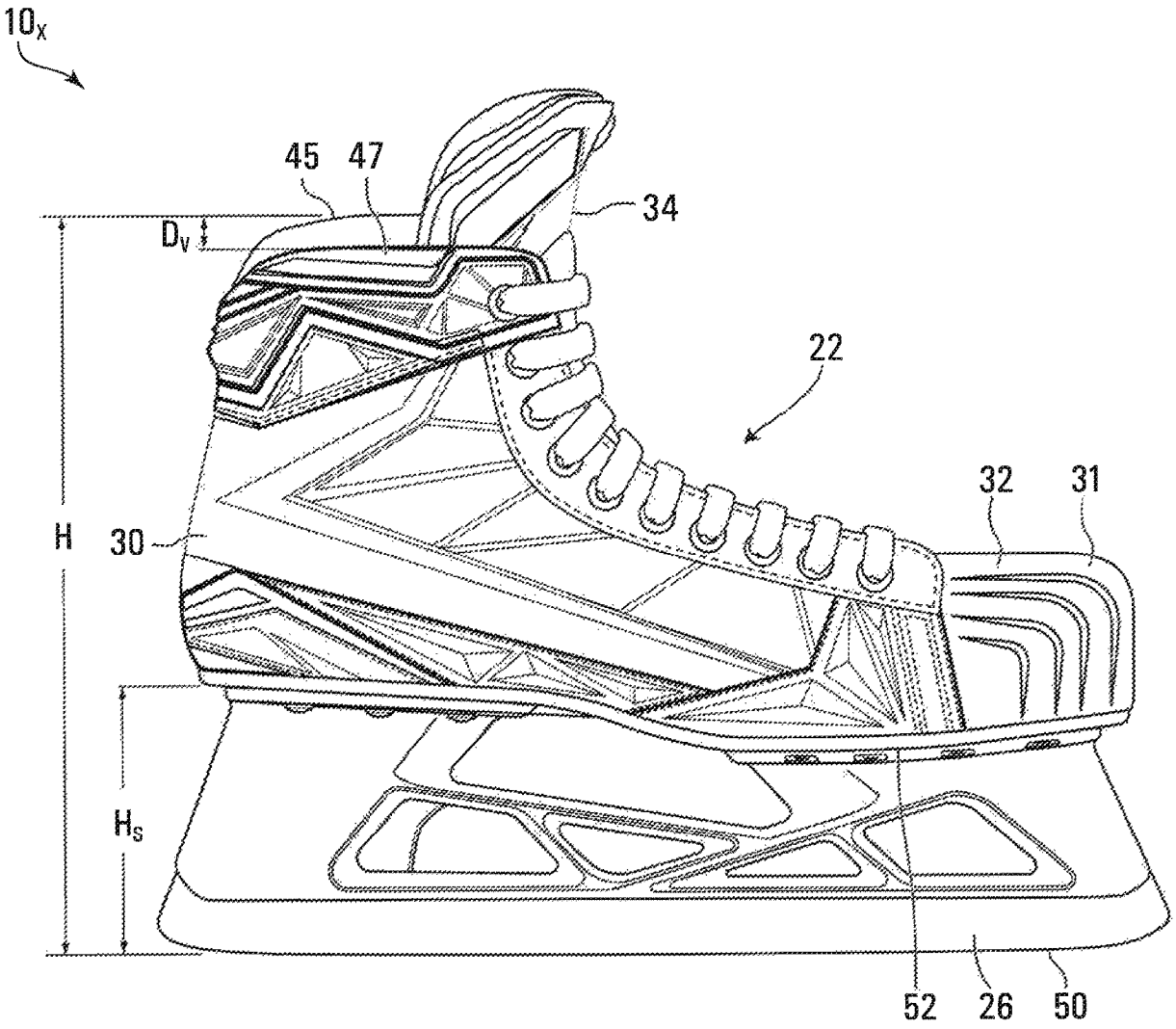
FIGS. 4 to 6 show a side view, a rear view and a top view of the goalie skate.
Figure 5:
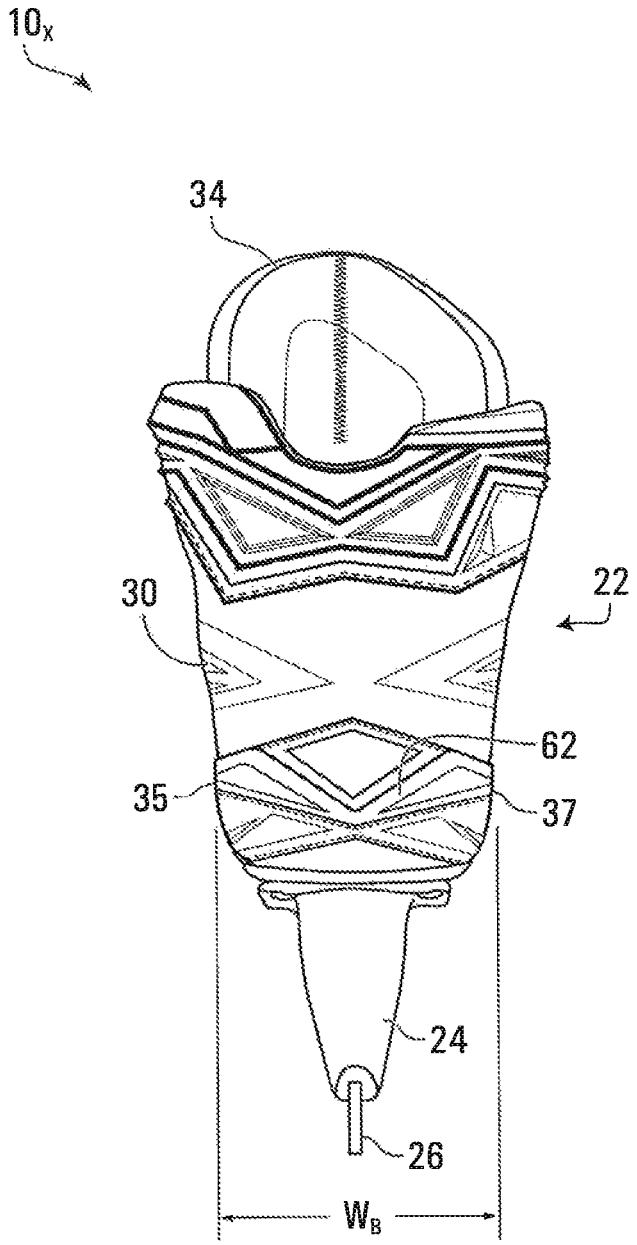
Figure 6:
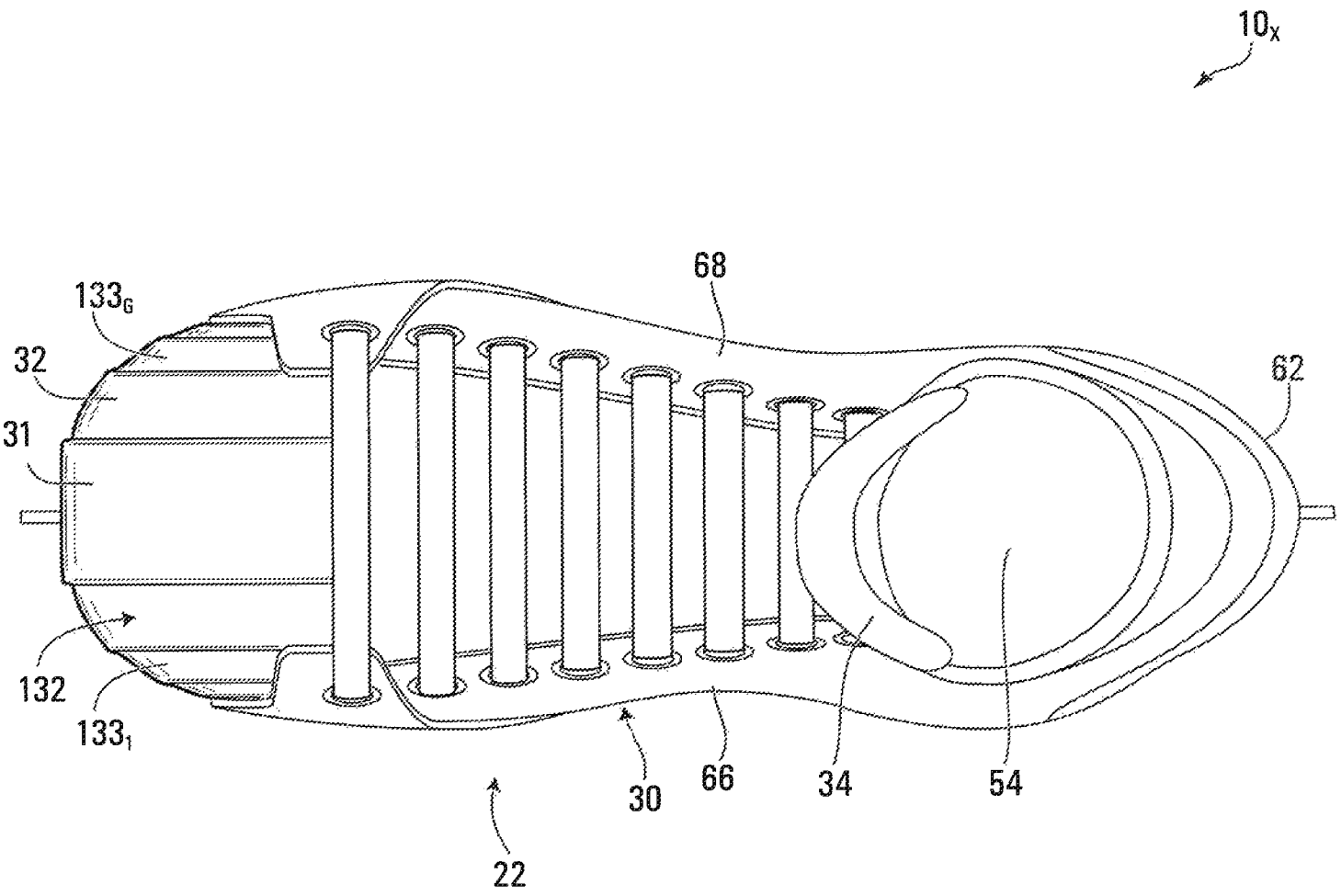

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

FIGS. 1 to 6 show an example of skates $\mathbf{10}_1$, $\mathbf{10}_2$ for a hockey goalkeeper 12 in accordance with an embodiment of the invention. The hockey goalkeeper 12, who will be referred to as a "goalie", defends his/her team's goal in a game of hockey played on a playing surface 14. The skates $\mathbf{10}_1$, $\mathbf{10}_2$ are worn by the goalie 12 to move on the playing surface 14 for goalkeeping. The goalie 12 also wears other equipment for goalkeeping, including, in this embodiment, leg pads $\mathbf{16}_1$, $\mathbf{16}_2$ to protect his/her legs when used to stop a projectile, i.e., a puck or ball, during play and/or when moving (e.g., dropping) them onto the playing surface 14, as well as a blocker 18 and a catcher 20 to stop the puck or ball with his/her arms and hands. In this embodiment, a type of hockey played is ice hockey such that the playing surface 14 is ice and the skates $\mathbf{10}_1$, $\mathbf{10}_2$ are goalie skates.

The skates $\mathbf{10}_1$, $\mathbf{10}_2$ are designed specifically for goalkeeping by the goalie 12, as opposed to other skates for hockey players other than goalies (i.e., forwards and defensemen), and can thus be referred to as "goalie skates". Each skate $\mathbf{10}_x$ comprises a skate boot 22 for receiving a foot 11 of the goalie 12, a blade 26 for contacting the ice 14, and a blade holder 24 between the skate boot 22 and the blade 26. The skate $\mathbf{10}_x$ has a longitudinal direction, a widthwise direction, and a height-wise direction.

In this embodiment, the skate $\mathbf{10}_x$ is constructed to help enhance performance of the goalie 12, including, for example, by being lighter and facilitating pushing (e.g., quicker and harder pushes) against the ice 14, which may improve mobility on the ice 14. The skate $\mathbf{10}_x$ also facilitates removal of the blade 26, such as to replace the blade 26 with another blade or to sharpen or perform another operation on the blade 26 before installing it back into the skate $\mathbf{10}_x$.

Figure 7:
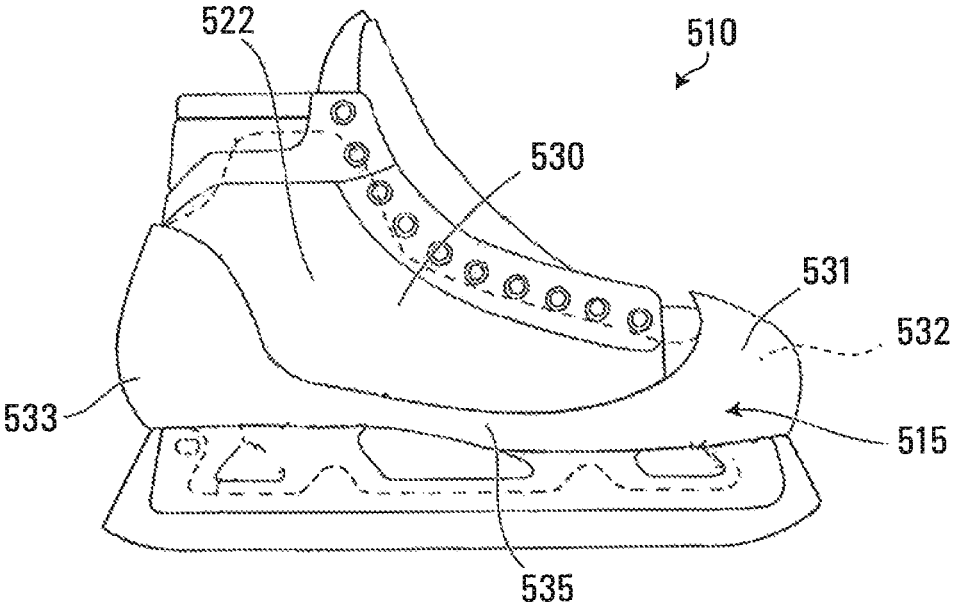
FIG. 7 Prior Art
FIGS. 7 and 8 show lateral and medial side views of a typical goalie skate comprising a cowling.
Figure 8:
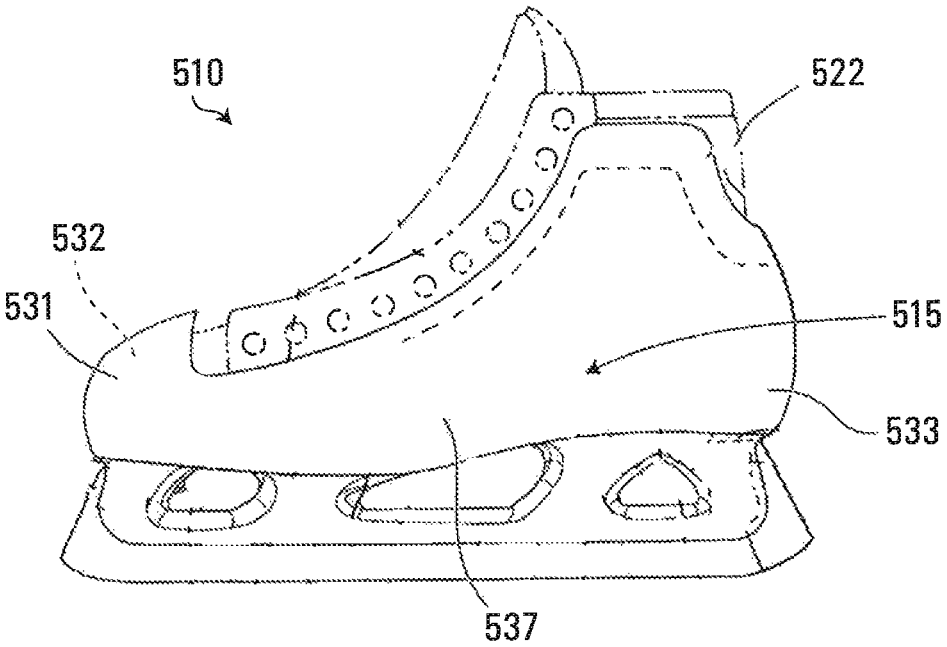
FIG. 8 Prior Art

Notably, in this embodiment, this is achieved by the skate $\mathbf{10}_x$ being cowlingless, i.e., being free of (i.e., without) any cowling (i.e., hard cover) covering a toe area 31, a heel area 33, a lower medial area 35, and a lower lateral area 37 of the skate boot 22. This is in contrast to a conventional skate 510 for a hockey goalie, as shown in FIGS. 7 and 8, which comprises a cowling 515 covering a toe area 531, a heel area 533, a lower medial area 535, and a lower lateral area 537 of a skate boot 522.

In addition to being cowlingless, in this embodiment, the skate $\mathbf{10}_x$ supports the goalie's foot 11 relatively high relative to the ice 14. A support height $H_S$ of the skate 10$x$, which refers to a height from a bottom 50 of the blade 26 to a bottom 52 of the skate boot 22, may be relatively large. For example, in some embodiments, a ratio $H_S/H$ of the support height $H_S$ of the skate $\mathbf{10}_x$ over an overall height H of the skate $\mathbf{10}_x$ may be at least 0.25, in some cases 0.275, in some cases at least 0.30, in some cases at least 0.325, in some cases at least 0.35, and in some cases even more. The ratio of the support height $H_S$ of the skate $\mathbf{10}_x$ over the overall height H of the skate $\mathbf{10}_x$ may have any other value in other embodiments. For instance, in some embodiments, the support height $H_S$ of the skate $\mathbf{10}_x$ may be at least 70 mm, in some cases at least 75 mm, in some cases at least 80 mm, in some cases at least 85 mm, and in some cases even more. The support height $H_S$ of the skate $\mathbf{10}_x$ may have any other value in other embodiments.

Figure 9:
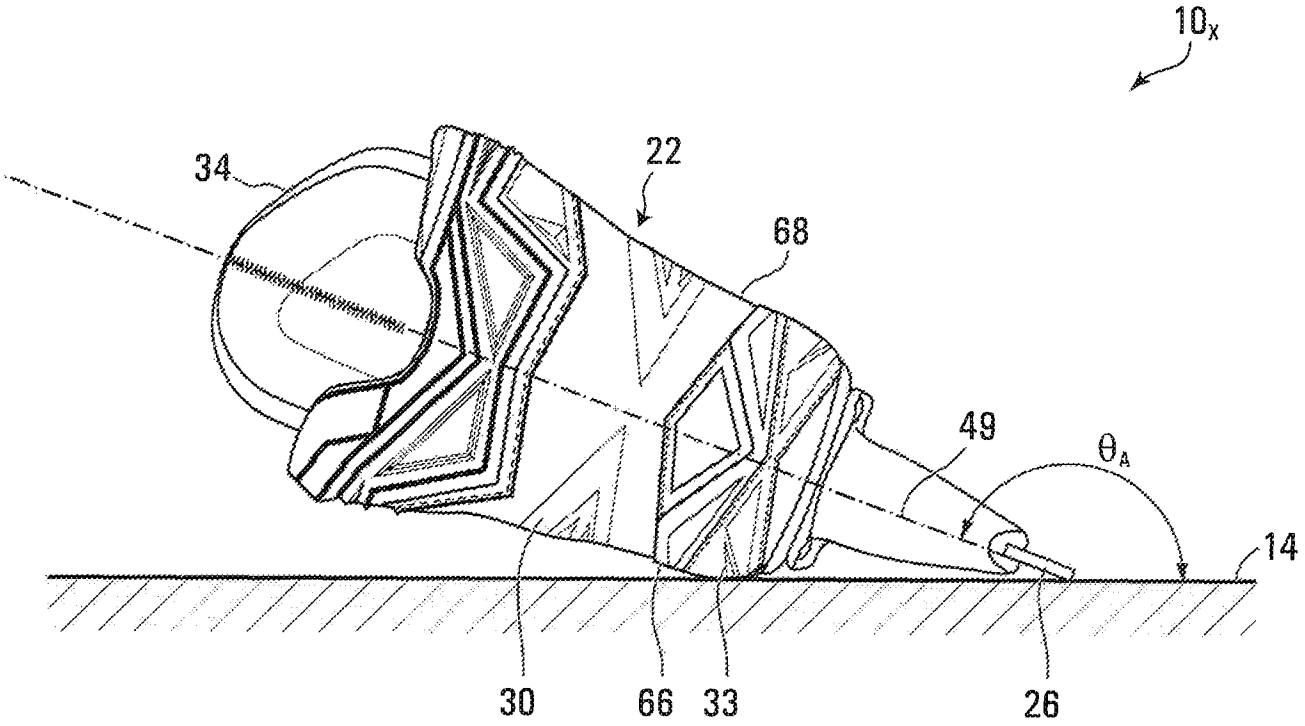
FIG. 9 shows a rear view of the goalie skate when the goalie skate engages a playing surface at a maximal attack angle.
Figure 10:
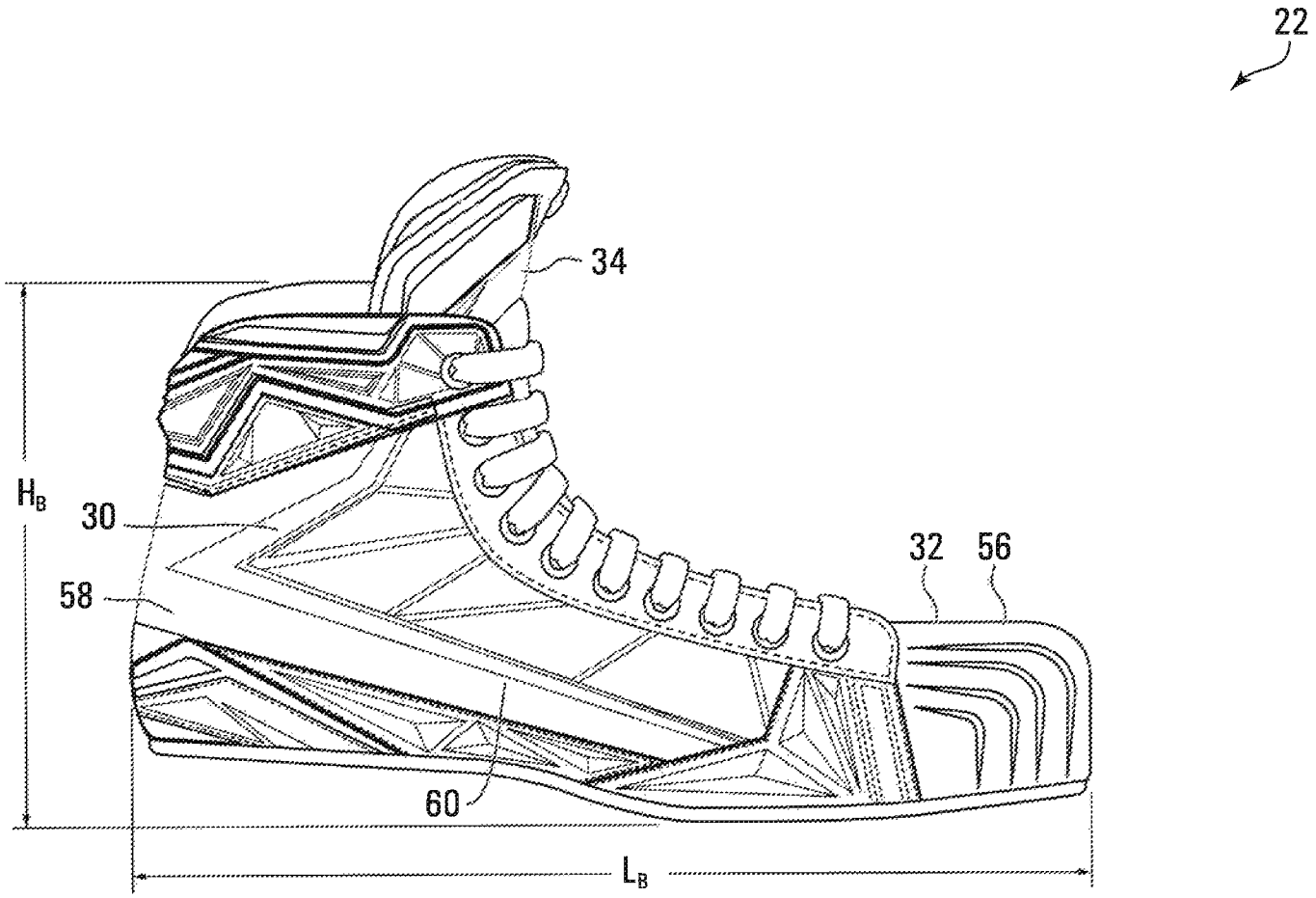
FIG. 10 shows a side view of a skate boot of the goalie skate.
Figure 11:
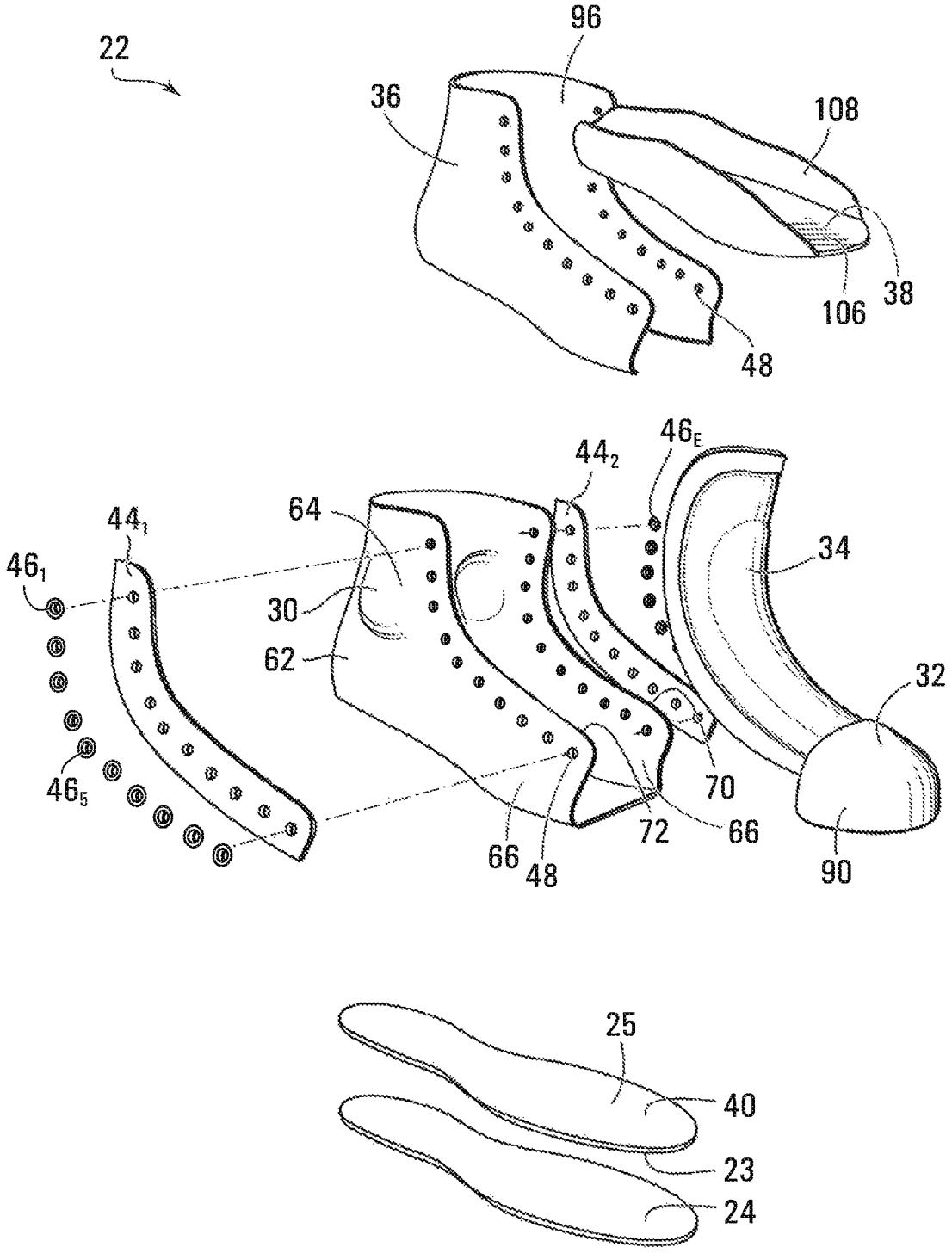
FIG. 11 shows an exploded view of the skate boot of the goalie skate, including an outer shell, a tongue, a toe cap, and an inner lining of the skate boot.
Figure 12:
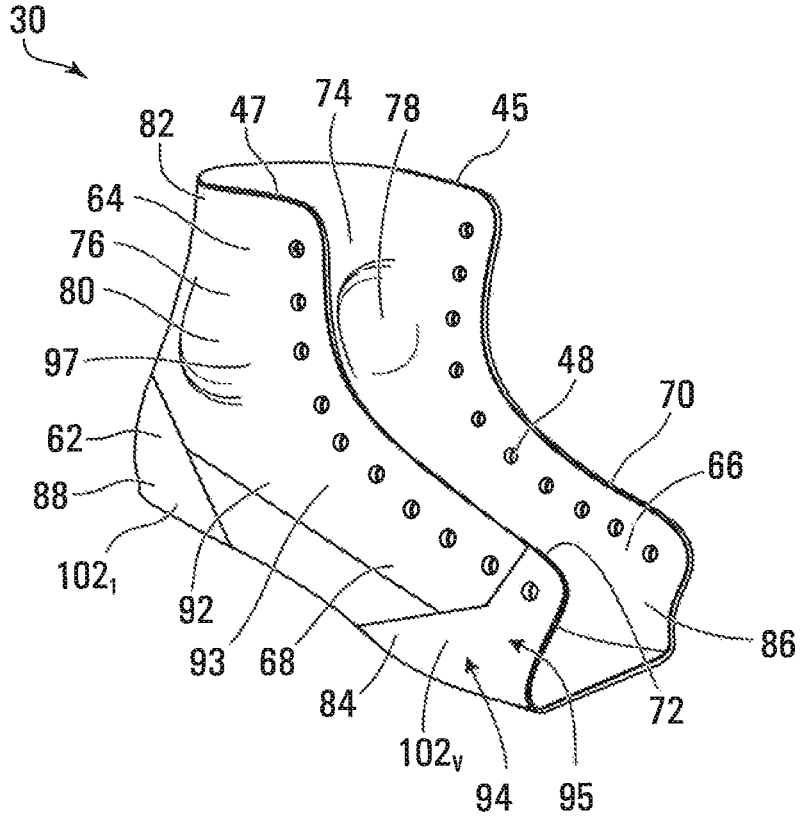
FIG. 12 shows a perspective view of the outer shell of the skate boot including a body and an overlay of the outer shell.

By being cowlingless, in this embodiment, as shown in FIG. 9, the skate $\mathbf{10}_x$ allows an angle of attack $\theta_A$ with the ice 14 that can be larger (e.g., greater than for conventional hockey goalkeeper skates with cowlings). The angle of attack $\theta_A$ of the skate $\mathbf{10}_x$ with the ice 14 refers to an angle between the ice 14 and a plane 49 of the blade 26 when the skate $\mathbf{10}_x$ is inclined relative to the ice 10 such that a medial surface of the skate $\mathbf{10}_x$ touches the ice 14. Allowing the angle of attack $\theta_A$ of the skate $\mathbf{10}_x$ with the ice 14 to be larger may help the goalie 12 to execute quicker and harder pushes against the ice 14. For example, in some embodiments, the angle of attack $\theta_A$ of the skate $\mathbf{10}_x$ with the ice 14 may be at least 140°, in some cases at least 142°, in some cases at least 145°, in some cases at least 148°, in some cases at least 150°, and in some cases even more. The angle of attack $\theta_A$ of the skate $\mathbf{10}_x$ with the ice 14 may have any other value in other embodiments.

Figure 42:
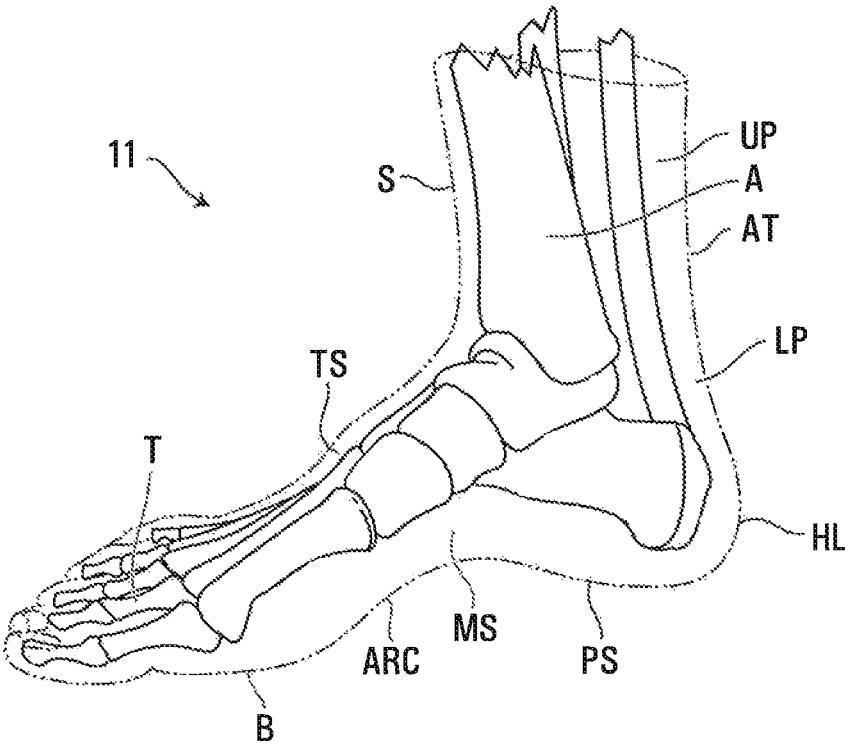
FIGS. 42 and 43 are side and front views of a right foot of the goalie with an integument of the foot shown in dotted lines and bones shown in solid lines.
Figure 43:
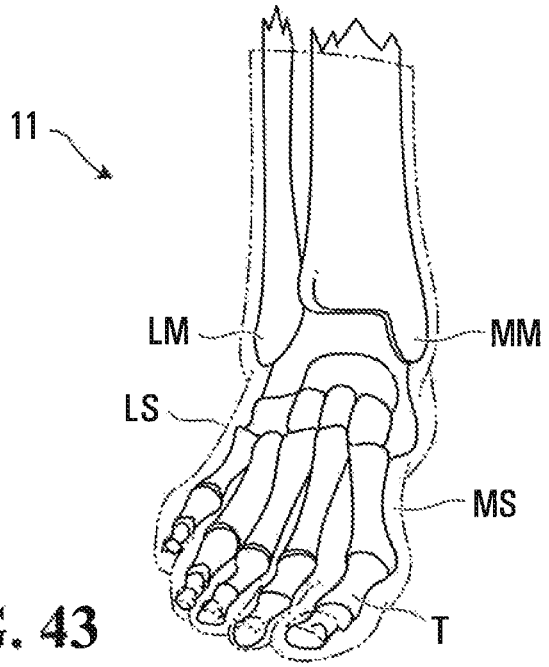

The skate boot 22 defines a cavity 54 for receiving the goalie's foot 11. With additional reference to FIGS. 42 and 43, the goalie's foot 11 includes toes T, a ball B, an arch ARC, a plantar surface PS, a top surface TS, a medial side MS, and a lateral side LS. The top surface TS of the goalie's foot 11 is continuous with a lower portion of a shin S of the goalie 12. In addition, the goalie 12 has a heel HL, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel HL. A forefoot of the goalie 12 includes the toes T and the ball B, a hindfoot of the goalie includes the heel HL, and a midfoot of the goalie is between the forefoot and the hindfoot.

The skate boot 22 comprises a front portion 56 for receiving the toes T of the goalie 12, a rear portion 58 for receiving the heel HL and at least part of the Achilles tendon AT and the ankle A of the goalie 12, and an intermediate portion 60 between the front portion 56 and the rear portion 58.

As it is for goalkeeping, the skate boot 22 may be shorter than skate boots of conventional skates for hockey players other than goalies. For example, in some embodiments, a ratio $H_B/L_B$ of a height $H_B$ of the skate boot 22 over a length $L_B$ of the skate boot 22 may be no more than 0.8, in some cases no more than 0.775, in some cases no more than 0.75, in some cases no more than 0.725, and in some cases even less.

More particularly, in this embodiment, the skate boot 22 comprises an outer shell 30, a toe cap 32, a tongue 34, an inner lining 36, a footbed 38, an insole 40, and an outsole 42. The skate boot 22 also comprises lace members $\mathbf{44}_1$, $\mathbf{44}_2$ and eyelets $\mathbf{46}_1$-$\mathbf{46}_E$ extending through (e.g., punched into) the lace members $\mathbf{44}_1$, $\mathbf{44}_2$, the outer shell 30 and the inner lining 36 vis-à-vis apertures 48 in order to receive laces for tying on the skate 10. In some embodiments, the skate boot 22 may not comprise any lace members and the eyelets $\mathbf{46}_1$-$\mathbf{46}_E$ may extend directly through the outer shell 30 and the inner lining 36 via the apertures 48.

The outer shell 30 imparts strength to the skate $\mathbf{10}_x$ to support the goalie's foot 11. More particularly, in this embodiment, the outer shell 30 comprises a heel portion 62 for receiving the heel HL of the goalie 12, an ankle portion 64 for receiving the ankle A of the goalie 12, and medial and lateral side portions 66, 68 for facing the medial and lateral sides MS, LS of the goalie's foot 11, respectively. The medial and lateral side portions 66, 68 include upper edges 70, 72 which connect to the lace members $\mathbf{44}_1$, $\mathbf{44}_2$. The heel portion 62 may be formed such that it is substantially cup-shaped for following the contour of the heel HL of the goalie 12. The ankle portion 64 comprises medial and lateral ankle sides 74, 76. The medial ankle side 74 has a medial depression 78 for receiving the medial malleolus MM of the goalie 12 and the lateral ankle side 76 has a lateral depression 80 for receiving the lateral malleolus LM of the goalie 12. The lateral depression 80 is located slightly lower than the medial depression 78 for conforming to the morphology of the goalie's foot 11. The ankle portion 64 further comprises a rear portion 82 facing the lower part LP of the Achilles tendon AT of the goalie 12. In this example, the skate boot 22 is free of (i.e., without) a tendon guard affixed to the rear portion 82 of the ankle portion 64 and extending upwardly therefrom as is conventionally found in skates for hockey players other than goalies.

In this embodiment, the lateral ankle side 76 of the ankle portion 64 extends lower than the medial ankle side 74 of the ankle portion 64 in the height-wise direction of the skate $\mathbf{10}_x$. More specifically, the ankle portion 64 comprises a medial upper edge 45 facing a medial side of the ankle of the goalie's foot 11 and a lateral upper edge 47 facing a lateral side of the ankle of the goalie's foot 11. The lateral upper edge 47 extends lower than the medial upper edge 45 in the height-wise direction of the skate $\mathbf{10}_x$ such that the medial upper edge 45 is higher than the lateral upper edge 47 by a vertical offset $D_V$. The lower lateral upper edge 47 may be helpful to relieve pressure on the lateral side LS of the goalie's foot 11 while allowing the goalie 12 to have a deeper stance (i.e., squat closer to the ice 14). Moreover, the higher medial upper edge 45 may provide additional protection and support to the goalie's foot 11. For example, the vertical offset $D_V$ of the lateral upper edge 47 and the medial upper edge 45 of the ankle portion 64 may be at least 10 mm, in some cases at least 15 mm, in some cases at least 20 mm, and in some cases even more.

The vertical offset $D_V$ may be significant relative to the overall height H of the skate $\mathbf{10}_x$. For instance, a ratio $D_V/H$ of the vertical offset $D_V$ of the lateral upper edge 47 and the medial upper edge 45 of the ankle portion 64 over the overall height H of the skate $\mathbf{10}_x$ may be at least 0.02, in some cases at least 0.04, in some cases at least 0.06, in some cases at least 0.08, and in some cases even more.

As the skate $\mathbf{10}_x$ is cowlingless, in this embodiment, a bottom region 84 of the lateral side portion 68 of the outer shell 30, a bottom region 86 of the medial side portion 66 of the outer shell 30, a bottom region 88 of the heel portion 62 of the outer shell 30, and a bottom region 90 of the toe cap 32 are exposed. This is in contrast to the conventional skate 510 for a hockey goalie, as shown in FIGS. 7 and 8, in which such bottom regions are covered by the cowling 515.

The outer shell 30 comprises a synthetic material 92 that makes up at least a substantial part (i.e., a substantial part or an entirety) of the outer shell 30. In this embodiment, the synthetic material 92 is a polymeric material. For example, in some embodiments, the polymeric material 92 may include polypropylene. In some cases, the polymeric material 92 may be a foam. For instance, in some cases, the polymeric material 92 may include an ethylene-vinyl acetate (EVA) foam or any other suitable foam. The polymeric material 92 may include any other suitable polymer in other embodiments (e.g., nylon, polyester, vinyl, polyvinyl chloride, an ionomer resin (e.g., Surlyn®), styrene-butadiene copolymer (e.g., K-Resin®) etc.). In some examples of implementation, the polymeric material 92 may be a polymer-matrix composite material (e.g., in which fibers are embedded in a polymer matrix). For instance, in some embodiments, the polymeric material 92 may comprise a self-reinforced polymer composite, such as self-reinforced polypropylene composite (e.g., Curv®). The synthetic material 92 may be implemented in any other suitable way in other embodiments (e.g., other types of polymers, other types of composite material, etc.).

In this embodiment, the synthetic material 92 of the outer shell 30 constitutes at least part of the heel portion 62, the ankle portion 64, and the medial and lateral side portions 66, 68 of the outer shell 30. In some examples, the synthetic material 92 of the outer shell 30 may constitute at least a majority (i.e., a majority or an entirety) of the heel portion 62, the ankle portion 64, and the medial and lateral side portions 66, 68 of the outer shell 30. In some embodiments, the synthetic material 92 of the outer shell 30 may constitute a given part of the outer shell 30, while the outer shell 30 may comprise one or more other synthetic materials, different from the synthetic material 92, that constitute one or more other parts of the outer shell 30.

In this example of implementation, the synthetic material 92 of the outer shell 30 is molded material. That is, the synthetic material 92 of the outer shell 30 is formed by a molding process in a mold. A shape of the synthetic material 92 of the outer shell 30 is thus a molded shape imparted during the molding process. More particularly, in this example of implementation, the synthetic material 92 of the outer shell 30 is thermoformed material. For instance, a sheet of the synthetic material 92 may be heated (e.g., in an oven) until it reaches a pliable forming temperature. The sheet of synthetic material 92 is then formed via a mold to have a shape of the outer shell 30.

Once the synthetic material 92 has cooled and any excess material has been trimmed, the outer shell 30 is complete and ready for assembly with other components of the skate $\mathbf{10}_x$. In other examples of implementation, the synthetic material 92 of the outer shell 30 may be molded in any other suitable way (i.e., injection molded).

The synthetic material 92 of the outer shell 30 may be relatively stiff. For instance, a stiffness of the synthetic material 92 of the outer shell 30 may be related to a modulus of elasticity (i.e., Young's modulus) of the synthetic material 92. For example, in some embodiments, the modulus of elasticity of the synthetic material 92 may be at least 4 GPa, in some cases at least 4.5 GPa, in some cases at least 5 GPa, in some cases at least 5.5 GPa, and in some cases even more. The modulus of elasticity of the synthetic material 92 of the outer shell 30 may have any other suitable value in other embodiments.

As the skate $\mathbf{10}_X$ is cowlingless, in this embodiment, the outer shell 30 is reinforced where exposed to impact with a puck during play. That is, in view of an absence of a cowling in the skate $\mathbf{10}_X$, the outer shell 30 is reinforced in one or more regions of the outer shell 30 expected to be impacted by a puck during play in order to properly protect the goalie's foot 11. To that end, the outer shell 30 comprises a reinforced part 94 exposed to impact with a puck during play. The reinforced part 94 of the outer shell 30 is strengthened to take into account the absence of a cowling in the skate $\mathbf{10}_X$. For instance, the reinforced part 94 of the outer shell 30 may have a material composition (e.g., a stronger material or an additional material) and/or a shape (e.g., a thicker area) that makes that part of the outer shell 30 more protective. In this example of implementation, the reinforced part 94 of the outer shell 30 does not extend over an entirety of the outer shell 30 such that the reinforced part 94, which may be more likely to be impacted by a puck during play, may provide more impact protection (e.g., be stronger and/or able to absorb more energy from impacts) than a non-reinforced part 97 of the outer shell 30 that is outside of the reinforced part 94 and that may be less likely to be impacted by a puck during play.

In this embodiment, the reinforced part 94 of the outer shell 30 comprises at least part of the medial and lateral side portions 66, 68 of the outer shell 30 and at least part of the heel portion 62 of the outer shell 30. For instance, the reinforced part 94 comprises the bottom region 84 of the lateral side portion 68, the bottom region 86 of the medial side portion 66, and the bottom region 88 of the heel portion 62 of the outer shell 30.

For instance, in this embodiment, the reinforced part 94 of the outer shell 30 has a thickness $T_R$ that is greater than a thickness $T_{NR}$ of the non-reinforced part 97 of the outer shell 30. For instance, in some embodiments, a ratio $T_R/T_{NR}$ of the thickness $T_R$ of the reinforced part 94 of the outer shell 30 over the thickness $T_{NR}$ of the non-reinforced part 97 of the outer shell 30 may be at least 1.1, in some cases at least 1.15, in some cases at least 1.2, in some cases at least 1.25, and in some cases even more. This ratio may have any other suitable value in other embodiments. For example, in some embodiments, the thickness $T_R$ of the reinforced part 94 of the outer shell 30 may be at least 7 mm, in some cases at least 8 mm, in some cases at least 9 mm, in some cases at least 10 mm, in some cases at least 11 mm, and in some cases even more. The thickness $T_R$ of the reinforced part 94 of the outer shell 30 may have any other suitable value in other embodiments.

For example, in some embodiments, a thickness of the lateral side portion 68 of the outer shell 30 may be at least 7 mm, in some cases at least 8 mm, in some cases at least 9 mm, and in some cases even more. In some embodiments, the thickness of the lateral side portion 68 of the outer shell 30 may be greater than a thickness of the medial side portion 66 of the outer shell 30. As another example, a thickness of the heel portion 62 of the outer shell 30 may be at least 7 mm, in some cases at least 8 mm, in some cases at least 9 mm, and in some cases even more. In some embodiments, the thickness of the heel portion 62 of the outer shell 30 may be greater than the thickness of the medial side portion 66 of the outer shell 30.

In some embodiments, only limited extents of the lateral side portion 68, the medial side portion 66, and/or the heel portion 62 of the outer shell 30 may be reinforced.

For example, in some embodiments, a thickness of the lateral side portion 68 may vary. For instance, as shown in FIG. 14B, a thickness of a first area 113 of the lateral side portion 68 of the outer shell 30 may be greater than a thickness of a second area 117 of the lateral side portion 68 of the outer shell 30. The first area 113 of the lateral side portion 68 of the outer shell 30 may be lower than the second area 117 of the lateral side portion 68 in the height-wise direction of the skate $\mathbf{10}_x$. For instance, a ratio of the thickness of the first area 113 of the lateral side portion 68 over the thickness of the second area 117 of the lateral side portion 68 may be at least 1.1, in some cases at least 1.2, in some cases at least 1.3, and in some cases even more. For example, a thickness of the bottom region 84 of the lateral side portion 68 may be greater than a thickness of an upper region 87 of the lateral side portion 68 of the outer shell 30.

Figure 15:
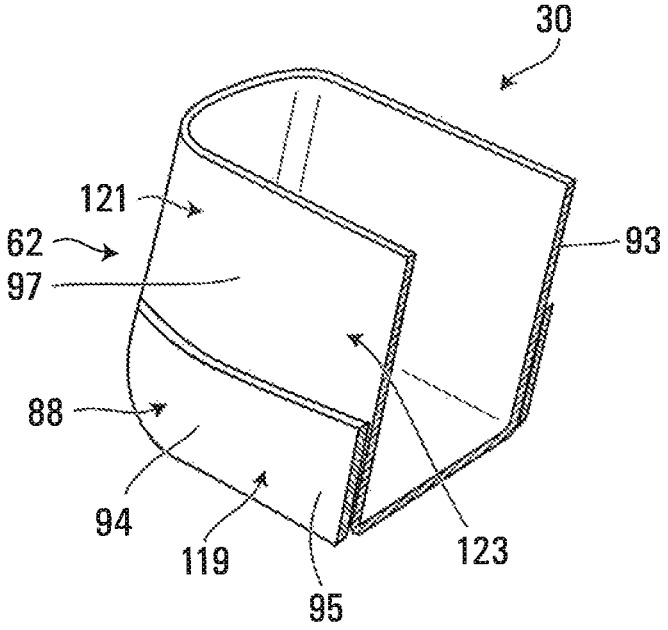
FIG. 15 shows a perspective view of a heel portion of the outer shell.
Figure 16:
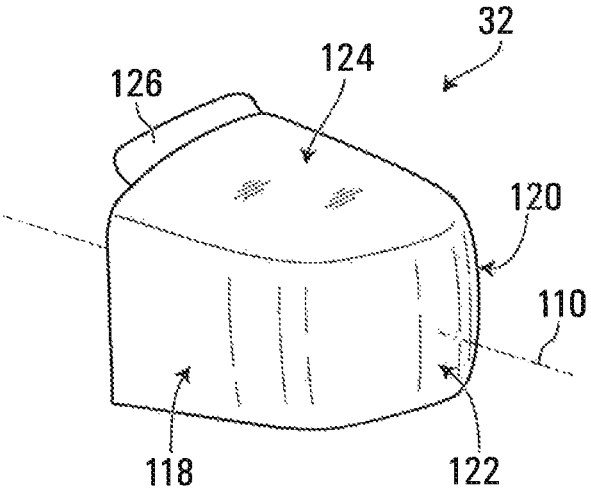
FIGS. 16 and 17 show perspective views of the toe cap of the skate boot.
Figure 17:
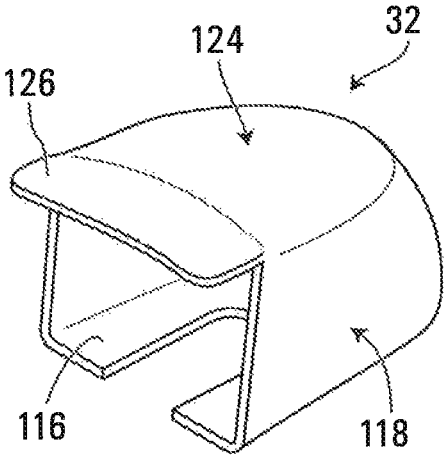
Figure 18:
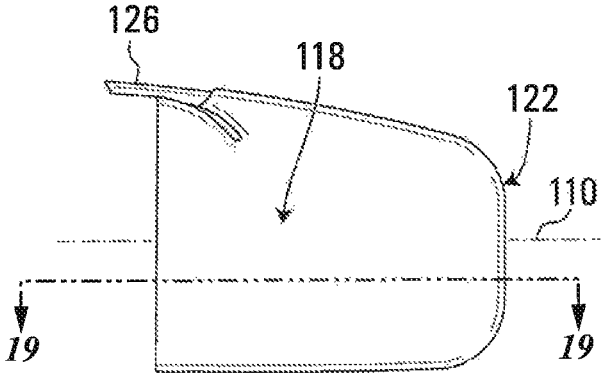
FIG. 18 shows a side view of the toe cap.
Figure 19:
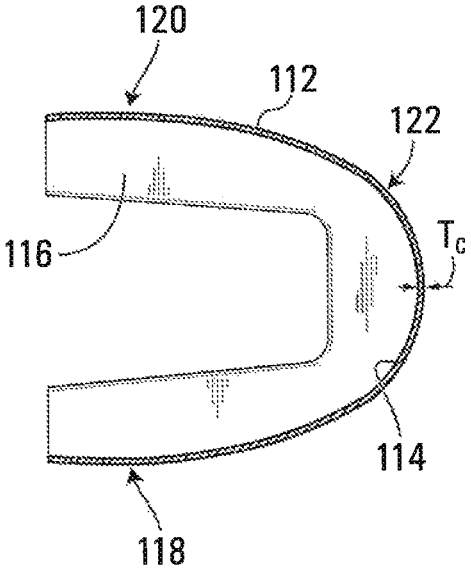
FIG. 19 shows a cross-sectional view of the toe cap taken along line 19-19 as indicated in FIG. 18.

As another example, in some embodiments, as shown in FIG. 15, a thickness of a first area 119 of the heel portion 62 of the outer shell 30 may be greater than a thickness of a second area 121 of the heel portion 62 of the outer shell 30. The first area 119 of the heel portion 62 of the outer shell 30 may be lower than the second area 121 of the heel portion 62 in the height-wise direction of the skate $\mathbf{10}_x$. For instance, a ratio of the thickness of the first area 119 of the heel portion 62 over the thickness of the second area 121 of the heel portion 62 may be at least 1.1, in some cases at least 1.2, in some cases at least 1.3, and in some cases even more. For example, a thickness of the bottom region 88 of the heel portion 62 may be greater than a thickness of an upper region 123 of the heel portion 62 of the outer shell 30.

While in this embodiment the thickness $T_R$ of the reinforced part 94 of the outer shell 30 is greater than the thickness $T_{NR}$ of the non-reinforced part 97 of the outer shell 30, the thickness $T_R$ of the reinforced part 94 of the outer shell 30 is comparatively small in relation to a sum of thicknesses of the cowling 515 and an outer shell 530 of the skate boot 522 of the conventional goalie skate 510. In view of this relatively small thickness $T_R$ of the reinforced part 94, a "lower foot-facing width" $W_B$ of the skate $\mathbf{10}_x$ may be smaller than a lower-foot-facing width of the conventional goalie skate 510. The lower-foot-facing width $W_B$ of the skate $\mathbf{10}_x$ is a width of the skate $\mathbf{10}_x$ measured in a lower portion of the skate boot 22 that faces the lateral and medial sides LS, MS of the goalie's foot 11. For instance, the lower-foot-facing width $W_B$ of the skate $\mathbf{10}_x$ may be measured at a bottommost two-inch extent of the skate boot 22. That is, the lower-foot-facing width $W_B$ of the skate $\mathbf{10}_x$ is a maximal width of the skate $\mathbf{10}_x$ measured between the bottom 52 of the skate boot 22 and a point two inches above the bottom 52 of the skate boot 22 in the height-wise direction of the skate $\mathbf{10}_x$. For example, in some embodiments, for a North American size 8D senior goalie skate (i.e., a regular width size 8 senior goalie skate), the lower-foot-facing width $W_B$ of the skate $\mathbf{10}_x$ may be no more than 80 m, in some cases no more than 70 mm, in some cases no more than 60 mm, and in some cases even less. Moreover, regardless of a size designation of the skate $\mathbf{10}_x$, in some embodiments, a ratio of the lower-foot-facing width $W_B$ of the skate $\mathbf{10}_x$ over the overall height H of the skate $\mathbf{10}_x$ may be no more than 0.35, in some cases no more than 0.325, in some cases no more than 0.3, in some cases no more than 0.275, in some cases no more than 0.25, and in some cases even less.

In this embodiment, the outer shell 30 comprises a body 93 and an overlay 95 that defines the reinforced part 94 of the outer shell 30. The overlay 95 is affixed to an outer surface of the body 93. In this example, the overlay 95 extends continuously along at least a majority (i.e., a majority or an entirety) of a longitudinal extent of the outer shell 30. More particularly, in this embodiment, the overlay 95 extends over the bottom region 84 of the lateral side portion 68 of the outer shell 30, the bottom region 86 of the medial side portion 66 of the outer shell 30, and the bottom region 88 of the heel portion 62 of the outer shell 30.

Figure 13:
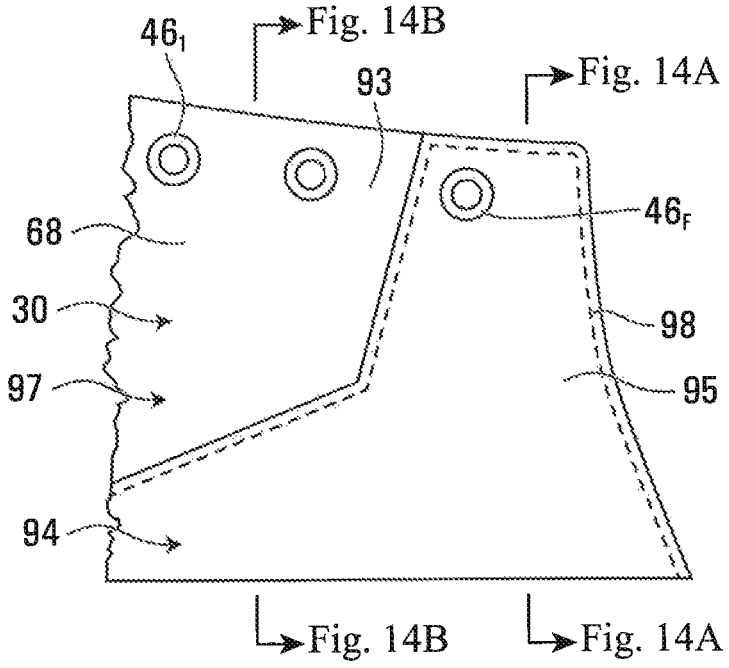
FIG. 13 shows a closeup view of part of a lateral side portion of the outer shell including the overlay.
Figure 14A:
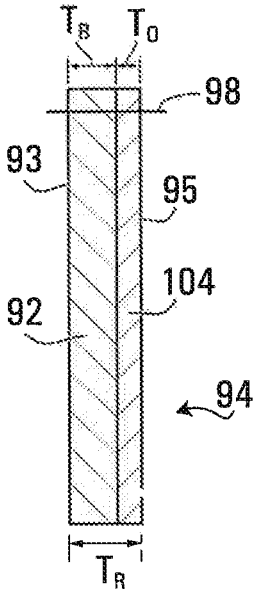
FIGS. 14A and 14B show a cross-sectional view of the outer shell taken along lines 14A-14A and 14B-14B respectively, as indicated in FIG. 13.
Figure 14B:
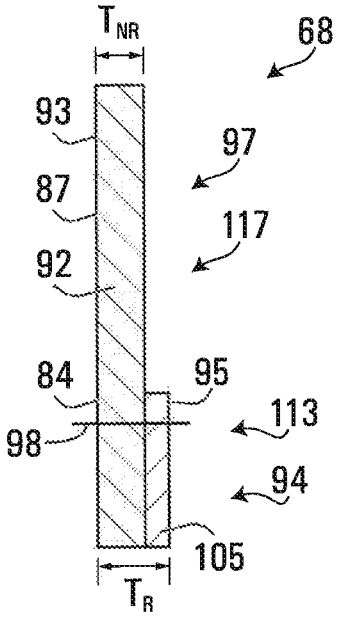

In this embodiment, as shown in FIGS. 13 and 14, the overlay 95 is affixed to the body 93 of the outer shell 30 via a stitching 98. The overlay 95 may be affixed to the body 93 of the outer shell 30 in any other suitable way. For example, the overlay 95 may be bonded (e.g., adhesively bonded), stapled, welded (e.g., ultrasonically welded), or overmolded onto the body 93 of the outer shell 30. Moreover, in this embodiment, the overlay 95 extends below the body 93 such that a portion of the overlay 95 (i.e., a bottom portion) extends between the body 93 and the outsole 42 of the skate boot 22. In other embodiments, the overlay 95 may not extend below the body 93 and may thus be affixed (e.g., via stitching) to the body 93 at a bottom portion of the overlay 95.

In this example of implementation, the overlay 95 comprises a plurality of overlay elements $\mathbf{102}_1$-$\mathbf{102}_V$ that make up the overlay 95. The overlay elements $\mathbf{102}_1$-$\mathbf{102}_V$ are positioned such that the overlay 95 is continuous (i.e., has no gaps). In other embodiments, the overlay 95 may comprise a single overlay element extending from the medial side 66 to the lateral side 68 of the outer shell 30.

The overlay 95 comprises a synthetic material 104 for imparting protection to the goalie's foot 11. More particularly, in this embodiment, the synthetic material 104 is more compliant (i.e., elastically deformable) than the synthetic material 92 making up the body 93 of the outer shell 30 such that the synthetic material 104 is capable of absorbing energy from impacts better than the synthetic material 92. To that end, a modulus of elasticity (i.e., Young's modulus) of the synthetic material 104 may be smaller than the modulus of elasticity of the synthetic material 92. For example, a ratio of the modulus of the synthetic material 104 of the overlay 95 over the modulus of the synthetic material 92 of the body 93 may be, in some cases, no more than 0.9, in some cases no more than 0.8, in some cases no more than 0.7, in some cases no more than 0.6 and in some cases even less.

Furthermore, in this embodiment, the synthetic material 104 of the overlay 95 has a thickness $T_O$ that is different from a thickness $T_B$ of the synthetic material 92 of the body 93 of the outer shell 30. More particularly, in this embodiment, the thickness $T_O$ of the synthetic material 104 of the overlay 95 is less than the thickness $T_B$ of the synthetic material 92 of the body 93. For instance, in some embodiments, a ratio $T_O/T_B$ of the thickness $T_O$ of the synthetic material 104 of the overlay 95 over the thickness $T_B$ of the synthetic material 92 of the body 93 may be no more than 0.25, in some cases no more than 0.2, in some cases no more than 0.15, and in some cases even less.

The inner lining 36 is affixed to an inner surface of the outer shell 30 and comprises an inner surface 96 for facing the heel HL and medial and lateral sides MS, LS of the goalie's foot 11 and ankle A in use. The inner lining 36 may be made of a soft material (e.g., a fabric made of NYLON® fibers or any other suitable fabric). The footbed 38 is mounted inside the outer shell 30 and comprises an upper surface 106 for receiving the plantar surface PS of the goalie's foot 11 and a wall 108 projecting upwardly from the upper surface 106 to partially cup the heel HL and extend up to a medial line of the goalie's foot 11. The insole 40 has an upper surface 25 for facing the plantar surface PS of the goalie's foot 11 and a lower surface 23 on which the outer shell 30 may be affixed.

The toe cap 32 is configured to face and protect the toes T of the goalie's foot 11. In this example, the toe cap 32 is affixed to the inner surface of the outer shell 30 at the medial and lateral side portions 66, 68 of the outer shell 30 and extends along a longitudinal axis 110. The toe cap 32 comprises an outer surface 112 and an inner surface 114 opposite the outer surface 112. A thickness $T_C$ of the toe cap 32 is measured between the outer and inner surfaces 112, 114 of the toe cap 32. The top cap 32 comprises a bottom portion 116 for at least partially covering a front portion of the lower surface 23 of the insole 40, a lateral side portion 118 for facing a small toe of the foot 11 of the goalie 12, a medial side portion 120 for facing a big toe of the foot 11 of the goalie 12, an end portion 122 between the lateral and medial side portions 118, 120, an upper portion 124 for facing a top of the toes T of the goalie's foot 11, and a top extension 126 for affixing the tongue 34 to the toe cap 32. The top extension 126 of the toe cap 32 may be affixed (e.g., glued and/or stitched) to a distal end portion of the tongue 34 in order to affix the tongue 34 to the toe cap 32.

The toe cap 32 comprises a synthetic material 105 that imparts stiffness to the toe cap 32. For instance, in various embodiments, the synthetic material 105 of the toe cap 32 may comprise nylon, polycarbonate materials (e.g., Lexan®), polyurethane, thermoplastics, thermosetting resins, reinforced thermoplastics, reinforced thermosetting resins, polyethylene, polypropylene, high density polyethylene or any other suitable material. In some cases, the synthetic material 105 of the toe cap 140 may be a composite material comprising thermoset material, thermoplastic material, carbon fibers and/or fiberglass fibers. For example, the composite material may be a fiber-matrix composite material that comprises a matrix in which fibers are embedded. The matrix may include any suitable polymeric resin, such as a thermosetting polymeric material (e.g., polyester, vinyl ester, vinyl ether, polyurethane, epoxy, cyanate ester, etc.), a thermoplastic polymeric material (e.g., polyethylene, polyurethane, polypropylene, acrylic resin, polyether ether ketone, polyethylene terephthalate, polyvinyl chloride, polymethyl methacrylate, polycarbonate, acrylonitrile butadiene styrene, nylon, polyimide, polysulfone, polyamide-imide, self-reinforcing polyphenylene, etc.), or a hybrid thermosetting-thermoplastic polymeric material. The fibers may be made of any suitable material such as carbon fibers, polymeric fibers such as aramid fibers, boron fibers, glass fibers, ceramic fibers, etc.

The synthetic material 105 of the toe cap 32 may be relatively stiff. For example, a stiffness of the synthetic material 105 of the toe cap 32 may be related to a modulus of elasticity (i.e., Young's modulus) of the synthetic material 105. For example, in this embodiment, the modulus of the synthetic material 105 of the toe cap 32 may be at least 0.5 GPa, in some cases at least 2 GPa, in some cases at least 3 GPa, in some cases at least 4 GPa, and in some cases even more.]

The modulus of elasticity of the synthetic material 105 of the toe cap 32 may have any other suitable value in other embodiments.

As the skate $\mathbf{10}_X$ is cowlingless, in this embodiment, the toe cap 32 is reinforced. That is, in view of an absence of a cowling in the skate $\mathbf{10}_X$, the toe cap 32 is reinforced to properly protect the goalie's toes. The toe cap 32 is thus strengthened to take into account the absence of a cowling in the skate $\mathbf{10}_X$. For instance, the toe cap 32 may have a material composition (e.g., a stronger material or an additional material) and/or a shape (e.g., a thicker area) that makes the toe cap 32 more protective.

In this embodiment, the toe cap 32 is reinforced via an increase of a thickness $T_C$ of the toe cap 32. For instance, the thickness $T_C$ of the toe cap 32 may be greater than that of a toe cap 532 of the conventional goalie skate 510. For example, in some embodiments, the thickness $T_C$ of the toe cap 32 may be at least 5 mm, in some cases at least 6 mm, in some cases at least 7 mm, and in some cases even more. The thickness $T_C$ of the toe cap 32 may have any other suitable value in other embodiments.

Also, in this embodiment, the toe cap 32 comprises a reinforcement 132. In this example, the reinforcement 132 is disposed on the outer surface 112 of the toe cap 32. The reinforcement 132 may be provided on one or more of the lateral side portion 118, the medial side portion 120, the end portion 122 and the upper portion 124 of the toe cap 32.

In this example, the reinforcement 132 comprises a plurality of reinforcing elements $\mathbf{133}_1$-$\mathbf{133}_G$ distributed on the toe cap 32. More particularly, in this embodiment, each of the reinforcements $\mathbf{133}_1$-$\mathbf{133}_G$ extends along a front-to-rear direction of the toe cap 32 (i.e., generally along a direction of the longitudinal axis 110). In other embodiments, the reinforcements $\mathbf{133}_1$-$\mathbf{133}_G$ may extend in any other direction (e.g., a direction transversal to the longitudinal axis 110). In this case, each of the reinforcements $\mathbf{133}_1$-$\mathbf{133}_G$ comprises a projection 134 projecting on the outer surface 112 of the toe cap 132. For example, the projection 134 may be a rib, a ridge, or any other suitable projection. The reinforcements $\mathbf{133}_1$-$\mathbf{133}_G$ may form corrugations on the outer surface 112 of the toe cap 32.

Figure 22:
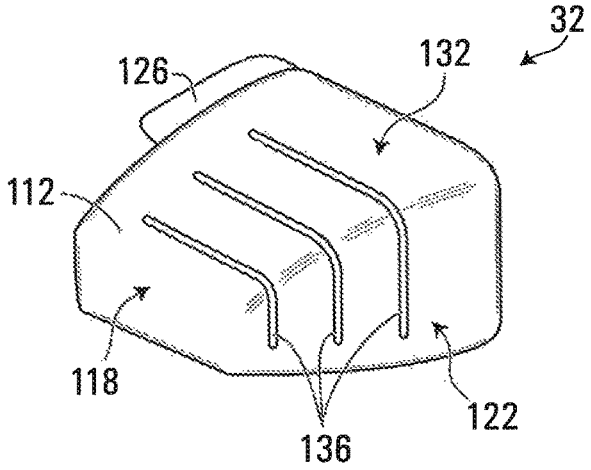
Figure 23:
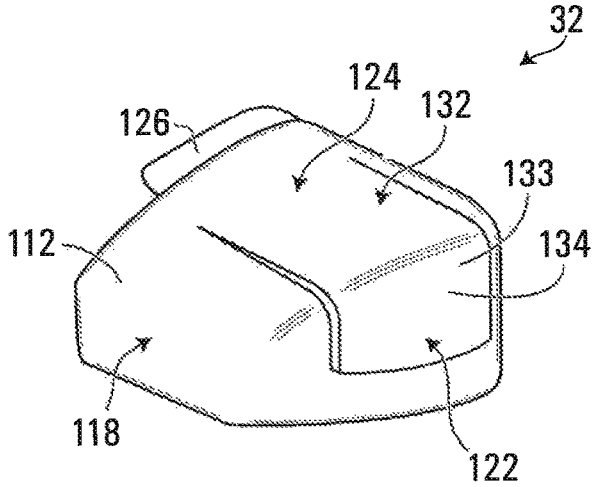

The reinforcement 132 may be implemented in any other suitable way in other embodiments. For example, in other embodiments, as shown in FIG. 22, each of the reinforcements $\mathbf{133}_1$-$\mathbf{133}_G$ may comprise a recess 136 on the outer surface 112 of the toe cap 32. For instance, the recess 136 may consist of a groove. As another example, in some embodiments, as shown in FIG. 23, the reinforcement 132 may have a single reinforcing element 133, such as a single projection 134.

The outsole 42 is affixed to an underside of the outer shell 30 for forming the skate boot 22. The outsole 42 comprises a rigid material for imparting rigidity to the outsole 42. More particularly, in this embodiment, the rigid material of the outsole 42 comprises a composite material. For example, the composite material may be a fiber-matrix composite material that comprises a matrix in which fibers are embedded. The matrix may include any suitable polymeric resin, such as a thermosetting polymeric material (e.g., polyester, vinyl ester, vinyl ether, polyurethane, epoxy, cyanate ester, etc.), a thermoplastic polymeric material (e.g., polyethylene, polypropylene, acrylic resin, polyether ether ketone, polyethylene terephthalate, polyvinyl chloride, polymethyl methacrylate, polycarbonate, acrylonitrile butadiene styrene, nylon, polyimide, polysulfone, polyamide-imide, self-reinforcing polyphenylene, etc.), or a hybrid thermosetting-thermoplastic polymeric material. The fibers may be made of any suitable material such as carbon fibers, polymeric fibers such as aramid fibers, boron fibers, glass fibers, ceramic fibers, etc. In other embodiments, the rigid material may comprise any other suitable material (e.g., nylon, polycarbonate materials, polyurethane, thermoplastics, thermosetting resins, reinforced thermoplastics, reinforced thermosetting resins, polyethylene, polypropylene, high density polyethylene).

Figure 24:
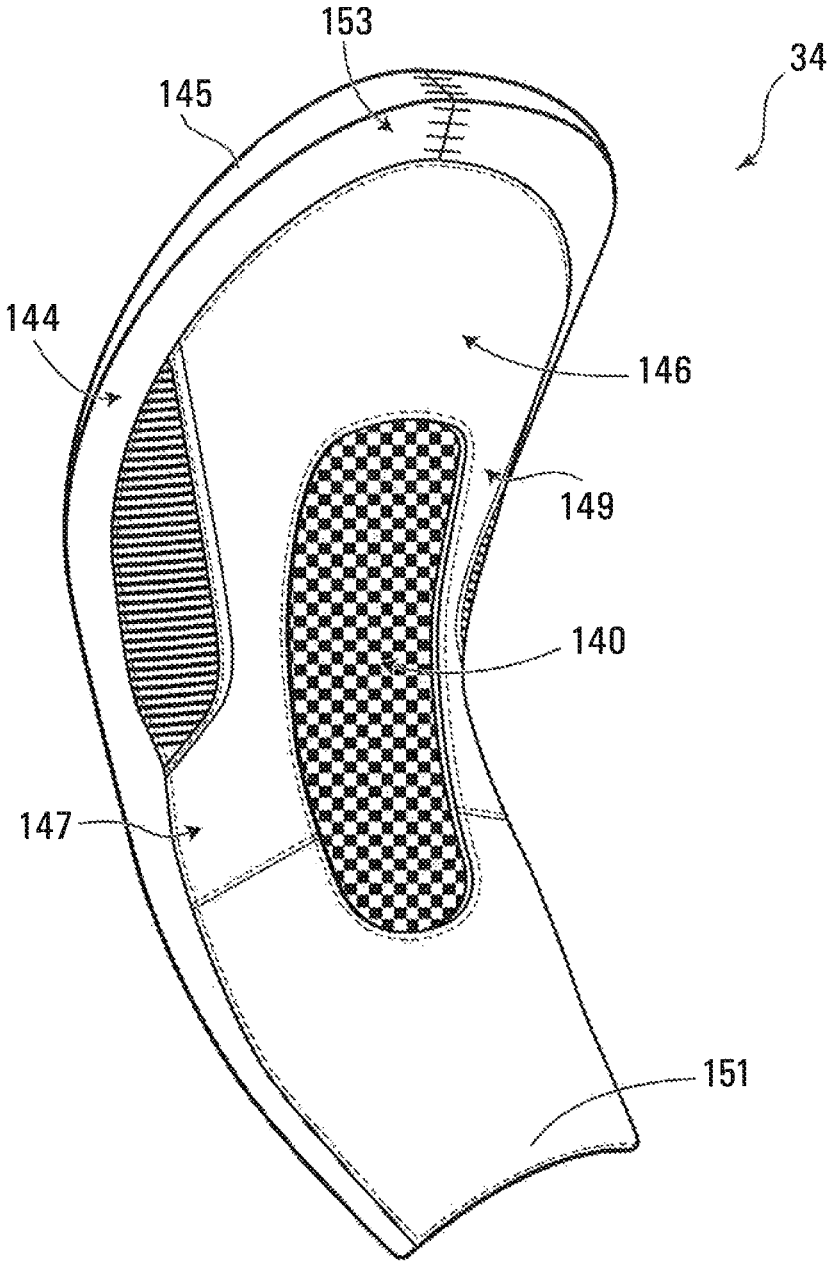
FIGS. 24 and 25 show a perspective view and an exploded of the tongue of the skate boot.
Figure 25:
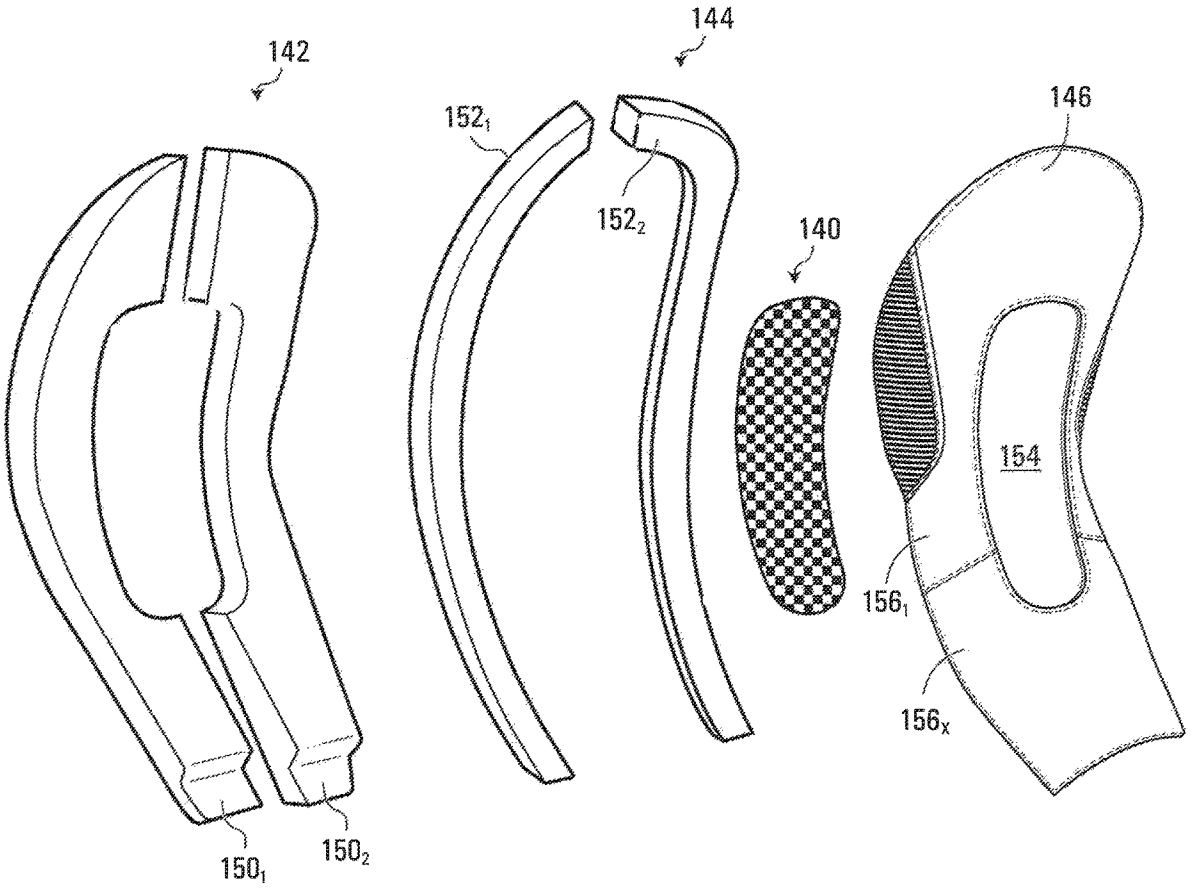

The tongue 34 extends upwardly and rearwardly from the toe cap 32 for overlapping the top surface TS of the goalie's foot 11. In this embodiment, with additional reference to FIGS. 24 and 25, the tongue 34 comprises a core 140 defining a section of the tongue 34 with increased rigidity, a padding member 142 for absorbing impacts to the tongue 34, a peripheral member 144 for at least partially defining a periphery 145 of the tongue 34, and a cover member 146 configured to at least partially define a front surface of the tongue 34. The tongue 34 defines a lateral portion 147 overlying a lateral portion of the goalie's foot 11 and a medial portion 149 overlying a medial portion of the goalie's foot 11. The tongue 34 also defines a distal end portion 151 for affixing to the toe cap 32 (e.g., via stitching) and a proximal end portion 153 that is nearest to the goalie's shin S.

The core 140 comprises one or more materials suitable for providing additional rigidity to the tongue 34. For instance, in this embodiment, the core 140 comprises a padding reinforced with a rigid insert. The rigid insert of the core 140 may comprise any suitable material to provide additional rigidity to the tongue 34. For example, the rigid insert may comprise a plastic material (e.g., nylon) and/or a composite material (e.g., carbon fiber). The rigid insert may comprise any other suitable material in other embodiments.

The padding member 142 is configured to surround the core 140 and is affixed thereto (e.g., via stitching). The padding member 142 comprises a material 148 suitable for absorbing impacts. For instance, in this embodiment, the material 148 comprises felt. In other embodiments, the material 148 of the padding member 142 may comprise a foam material, a fibrous material, a non-woven material, a laminate material (e.g., foam "sandwiched" between layers of textile) or any other suitable material. The material 148 of the padding member 142 may be one of a plurality of materials of the padding member 142. For example, in some cases, the padding member 142 may comprise an additional material (e.g., foam) that is layered on top of the material 148. Moreover, in this embodiment, the padding member 142 comprises a pair of padding elements $\mathbf{150}_1$, $\mathbf{150}_2$ that are affixed to one another to form the padding member 142. In this example, the padding elements $\mathbf{150}_1$, $\mathbf{150}_2$ are lateral and medial padding elements $\mathbf{150}_1$, $\mathbf{150}_2$.

The peripheral member 144 is affixed to the padding member 142 such as to define the periphery of the tongue 34. In this embodiment, the peripheral member 144 comprises a pair of peripheral elements $\mathbf{152}_1$, $\mathbf{152}_2$ that are affixed to one another, and to the padding member 142, to form the peripheral member 144. More particularly, in this embodiment, the peripheral elements $\mathbf{152}_1$, $\mathbf{152}_2$ are lateral and medial peripheral elements $\mathbf{152}_1$, $\mathbf{152}_2$.

The cover member 146 constitutes an aesthetic appearance of the front surface of the tongue 32. As such, the cover member 146 may comprise a variety of decorative features such as a textured surface (e.g., ridges, grooves, etc.), a trademark or logo stitched thereto or a section defining a different color. In some embodiments, the decorative features such as the logo may be printed or formed (e.g., embossed) on the cover member 146. In this embodiment, the cover member 146 comprises a plurality of cover elements $\mathbf{156}_1$-$\mathbf{156}_x$ that are affixed to one another (e.g., via stitching or gluing) in order to form the cover member 146. Moreover, in its assembled state, the cover member 146 defines an opening 154 for exposing the core 140.

In this embodiment, the tongue 34 is configured to be asymmetric. More particularly, the lateral and medial portions 147, 149 of the tongue 34 extend to different heights such that the proximal portion 153 of the tongue 34 is uneven in the height-wise direction of the skate $\mathbf{10}_x$. Specifically, the medial portion 149 of the tongue 34 extends higher than the lateral portion 149 of the tongue 34. To that end, the lateral and medial padding elements $\mathbf{150}_1$, $\mathbf{150}_2$ are shaped differently from one another and the lateral and medial peripheral elements $\mathbf{152}_1$, $\mathbf{152}_2$ are shaped differently from one another. Moreover, the cover member 146 is also configured such that its lateral portion is shaped differently from its medial portion. This asymmetric design of the tongue 34 may provide additional padding at a pressure point of the tongue 34 and may minimize interference with the goalie's leg (e.g., in butterfly style).

The skate boot 22 may be constructed in any other suitable way in other embodiments. For example, in other embodiments, various components of the skate boot 22 mentioned above may be configured differently or omitted and/or the skate boot 22 may comprise any other components that may be made of any other suitable materials and/or using any other suitable processes.

Figure 26:
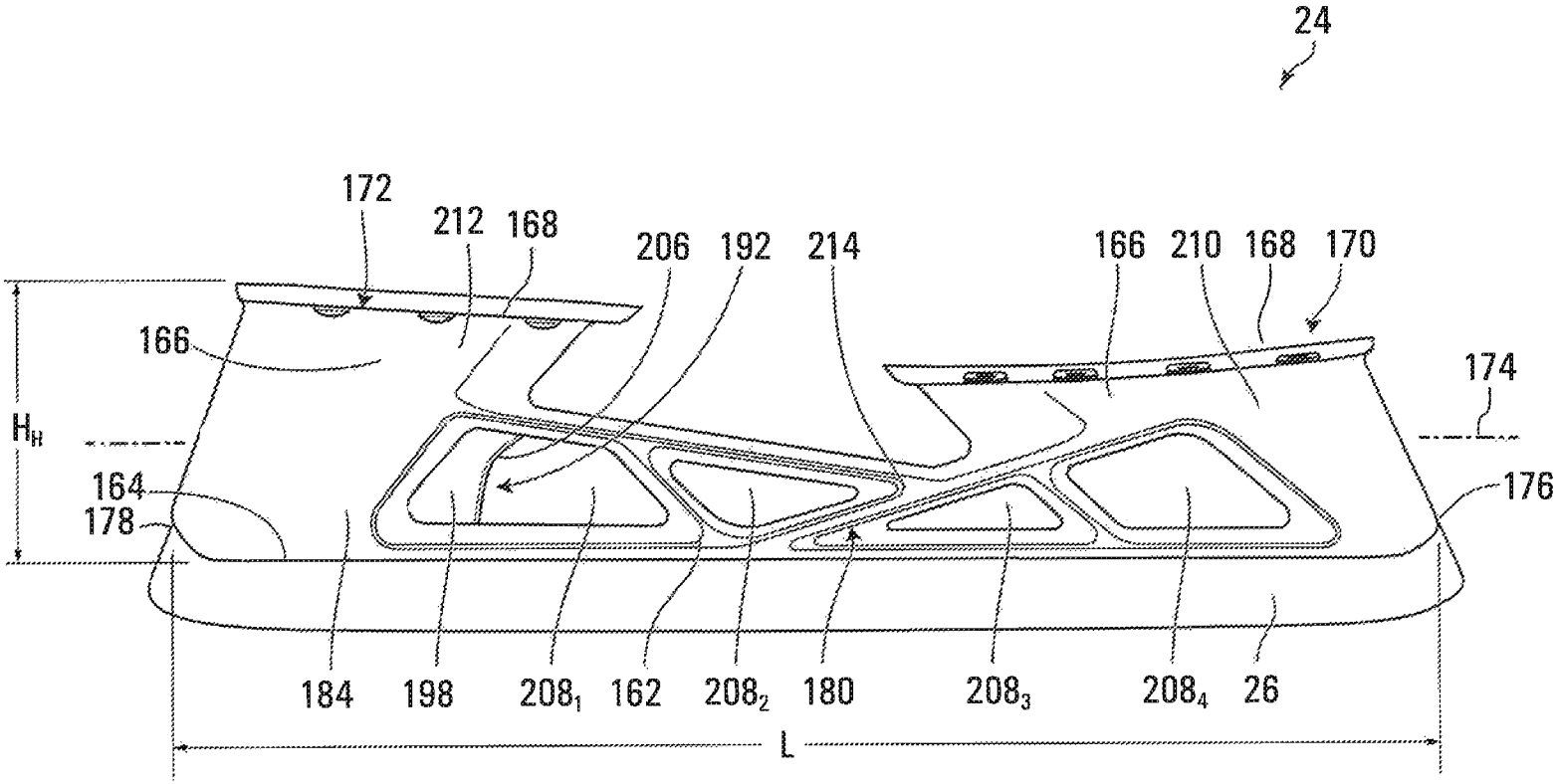
FIG. 26 shows a blade and a blade holder of the goalie skate.
Figure 27:
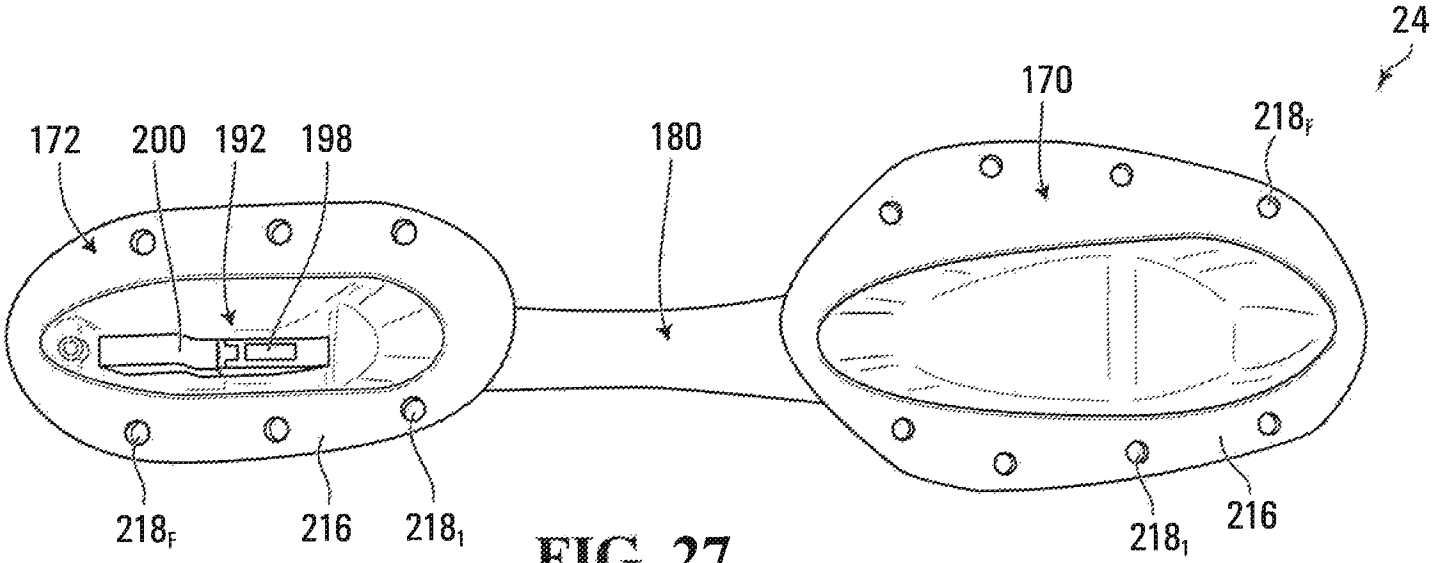
FIGS. 27 and 28 show a top view and a bottom view of the blade holder, including a blade-detachment mechanism.
Figure 28:
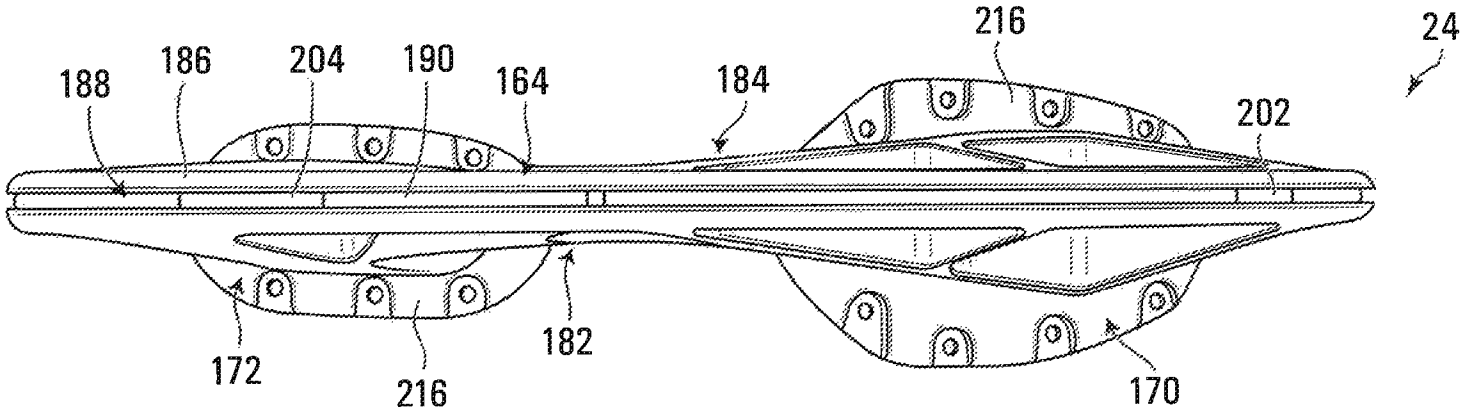

With additional reference to FIGS. 26 to 28, the blade holder 24 comprises a lower portion 162 comprising a blade-retaining base 164 that retains the blade 26 and an upper portion 166 comprising a support 168 that extends upwardly from the blade-retaining base 164 towards the skate boot 22 to interconnect the blade holder 24 and the skate boot 22. A front portion 170 of the blade holder 24 and a rear portion 172 of the blade holder 24 define a longitudinal axis 174 of the blade holder 24. The front portion 170 of the blade holder 24 includes a frontmost point 176 of the blade holder 24 and extends beneath and along the skater's forefoot in use, while the rear portion 172 of the blade holder 24 includes a rearmost point 178 of the blade holder 24 and extends beneath and along the skater's hindfoot in use. An intermediate portion 180 of the blade holder 24 is between the front and rear portion 170, 172 of the blade holder 24 and extends beneath and along the skater's midfoot in use. A length L of the blade holder 24 can be measured from the frontmost point 176 to the rearmost point 178. The blade holder 24 comprises a medial side 182 and a lateral side 184 that are opposite one another. The blade holder 24 has a longitudinal direction (i.e., a direction generally parallel to its longitudinal axis 174) and transversal directions (i.e., directions transverse to its longitudinal axis 174), including a widthwise direction (i.e., a lateral direction generally perpendicular to its longitudinal axis 174). The blade holder 24 also has a height direction normal to its longitudinal and widthwise directions.

The blade-retaining base 164 is elongated in the longitudinal direction of the blade holder 24 and is configured to retain the blade 26 such that the blade 26 extends along a bottom portion 186 of the blade-retaining base 164 to contact the ice surface. To that end, the blade-retaining base 164 comprises a blade-retention portion 188 to face and retain the blade 26. In this embodiment, the blade-retention portion 188 comprises a recess 190 in which an upper portion of the blade 26 is disposed.

The blade holder 24 can retain the blade 26 in any suitable way. In this embodiment, the blade holder 24 comprises a blade-detachment mechanism 192 such that the blade 26 is selectively detachable and removable from, and attachable to, the blade holder 24 (e.g., when the blade 26 is worn out or otherwise needs to be replaced or removed from the blade holder 24). More particularly, in this embodiment, the blade 26 includes a plurality of projections 194, 196. The blade-detachment mechanism 192 includes an actuator 198 and a biasing element 200 which biases the actuator 198 in a direction towards the front portion 170 of the blade holder 24. In this embodiment, the actuator 198 comprises a trigger. To attach the blade 26 to the blade holder 24, the front projection 194 is first positioned within a hollow space 202 (e.g., a recess or hole) of the blade holder 24. The rear projection 196 can then be pushed upwardly into a hollow space 204 (e.g., a recess or hole) of the blade holder 24, thereby causing the biasing element 200 to bend and the actuator 198 to move in a rearward direction. The rear projection 196 will eventually reach a position which will allow the biasing element 200 to force the actuator 198 towards the front portion 170 of the blade holder 24, thereby locking the blade 26 in place. The blade 26 can then be removed by pushing against a finger-actuating surface 206 of the actuator 198 to release the rear projection 196 from the hollow space 204 of the blade holder 24. Thus, in this embodiment, the blade-detachment mechanism 192 is free of any threaded fastener (e.g., a screw or bolt) to be manipulated to detach and remove the blade 26 from the blade holder 24 or to attach the blade 26 to the blade holder 24. Further information on examples of implementation of the blade-detachment mechanism 192 in some embodiments may be obtained from U.S. Pat. No. 8,454,030 hereby incorporated by reference herein. The blade-detachment mechanism 192 may be configured in any other suitable way in other embodiments.

In this embodiment, the blade-retaining base 164 comprises a plurality of apertures $\mathbf{208}_1$-$\mathbf{208}_4$ distributed in the longitudinal direction of the blade holder 24 and extending from the medial side 182 to the lateral side 184 of the blade holder 24. In this example, respective ones of the apertures $\mathbf{208}_1$-$\mathbf{208}_4$ differ in size. The apertures $\mathbf{208}_1$-$\mathbf{208}_4$ may have any other suitable configuration, or may be omitted, in other embodiments.

The blade-retaining base 164 may be configured in any other suitable way in other embodiments.

The support 168 is configured for supporting the skate boot 22 above the blade-retaining base 164 and transmit forces to and from the blade-retaining base 164 during skating. In this embodiment, the support 168 comprises a front pillar 210 and a rear pillar 212 which extend upwardly from the blade-retaining base 164 towards the skate boot 22. The front pillar 210 extends towards the front portion 56 of the skate boot 22 and the rear pillar 212 extends towards the rear portion 58 of the skate boot 22. The blade-retaining base 164 extends from the front pillar 210 to the rear pillar 212. More particularly, in this embodiment, the blade-retaining base 164 comprises a bridge 214 interconnecting the front and rear pillars 84, 86

The support 168 and the skate boot 22 can be connected to one another in any suitable way. In this embodiment, the support 168 is affixed to the skate boot 22. More particularly, in this embodiment, the front and rear pillars 210, 212 are fastened to the skate boot 22 by fasteners (e.g., rivets, screws, bolts). In this example, each of the front and rear pillars 210, 212 comprises a flange 216 including a plurality of apertures $\mathbf{218}_1$-$\mathbf{218}_F$ to receive respective ones of the fasteners that fasten the blade holder 24 to the skate boot 22. The support 168 may be affixed to the skate boot 22 in any other suitable manner in other embodiments (e.g, by an adhesive).

Figure 29:
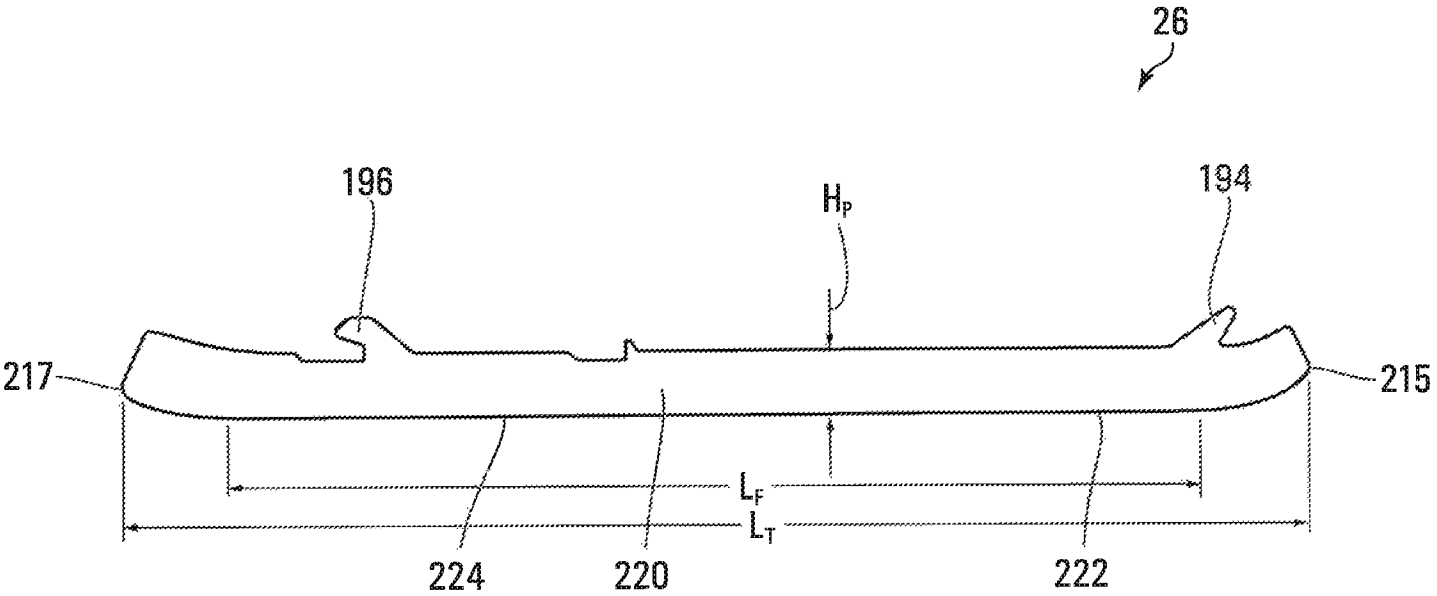
FIG. 29 shows a side view of the blade.

With additional reference to FIG. 29, the blade 26 comprises an ice-contacting material 220 including an ice-contacting surface 222 for sliding on the ice surface while the goalie 12 skates. In this embodiment, the ice-contacting material 220 is a metallic material (e.g., stainless steel). The ice-contacting material 220 may be any other suitable material in other embodiments. Also, in this embodiment, an entirety of the blade 26 is made of the ice-contacting material 220. The blade 26 has a length $L_T$ measured from a frontmost point 215 to a rearmost point 217 of the blade 26.

The ice-contacting surface 222 of the blade 26 comprises a flat portion 224 having a length $L_F$. The portion of the ice-contacting surface 222 that is not part of the flat portion 215 (i.e., on either side of the flat portion 125) diverges from the ice (e.g., is generally curved away from the ice). The length $L_F$ of the flat portion 224 is significant relative to the length $L_T$ of the blade 26 as opposed to that of blades of other skates for hockey players other than goalies (i.e., forwards and defensemen). For instance, a ratio $L_F/L_T$ of the length $L_F$ of the flat portion 224 of the blade over the length $L_T$ of the blade 26 may be at least 0.6, in some cases at least 0.65, in some cases at least 0.7, in some cases at least 0.75, in some cases at least 0.8, in some cases at least 0.85, and in some cases even more.

The blade 26 also has a width that is significant relative to a width of blades of other skates for hockey players other than goalies. For example, the width of the blade 26 may be at least 3 mm, in some cases at least 4 mm, in some cases at least 5 mm, and in some cases even more.

The blade holder 24 and the blade 26 may be designed to complementarily decrease a weight of the skate $\mathbf{10}_x$ while simultaneously increasing its support height $H_S$. For instance, in this embodiment, the blade holder 24 has a relatively large height $H_H$. That is, the height $H_H$ of the blade holder 24 is significant in comparison to the blade holder of conventional goalie skates. For example, a ratio $H_H/H_S$ of the height $H_H$ of the blade holder 24 over the support height $H_S$ of the skate $\mathbf{10}_x$ may be at least 0.7, in some cases at least 0.75, in some cases at least 0.8, in some cases at least 0.85, in some cases at least 0.9, and in some cases even more.

Simultaneously, the blade 26 may have a relatively small height $H_P$. That is, in this embodiment, the height $H_P$ of the blade 26 is small in comparison to the blade of conventional goalie skates. For example, a ratio $H_P/H_S$ of the height $H_P$ of the blade 26 over the support height $H_S$ of the skate $\mathbf{10}_x$ may be at least 0.15, in some cases at least 0.2, in some cases at least 0.25, in some cases at least 0.3 and in some cases even more. Moreover, a ratio $H_H/H_P$ of the height $H_H$ of the blade holder 24 over the height $H_P$ of the blade 26 may be at least 3, in some cases at least 3.5, in some cases at least 4, and in some cases even more.

As the blade 26 is typically denser than the blade holder 24, the increased height of the blade holder 24 and the decreased height of the blade 26 may cause a reduction in the weight of the skate $\mathbf{10}_x$. Moreover, the resulting increased support height $H_S$ also may also allow an increase in the maximum angle of attack $\theta_A$ of the skate $\mathbf{10}_x$.

The goalie skate $\mathbf{10}_x$ may be implemented in any other suitable way in other embodiments.

Figure 30:
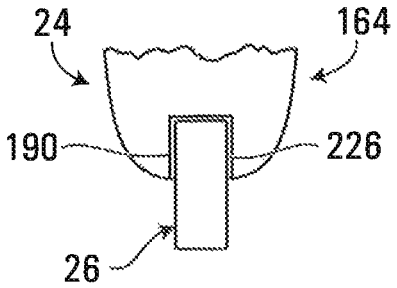
FIGS. 30 to 33 show variants in which the blade is permanently affixed to the blade holder.
Figure 31:
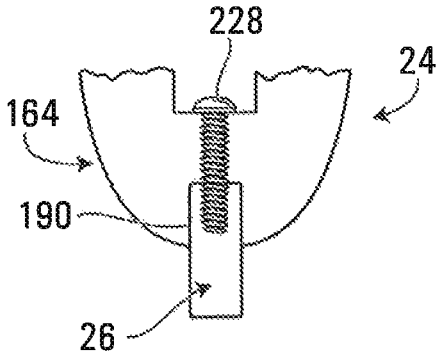
Figure 32:
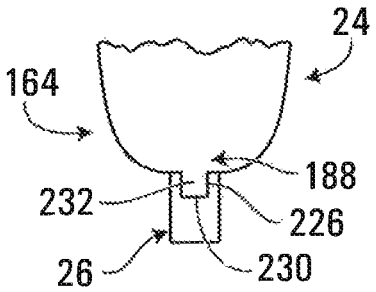
Figure 33:
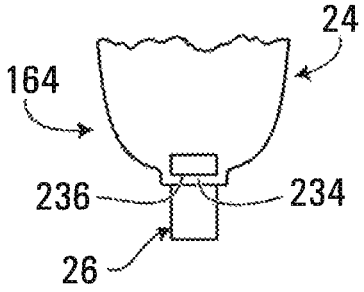

For instance, in a variant, the blade holder 24 may retain the blade 26 in any other suitable way. For instance, instead of being selectively detachable and removable from and attachable to the blade holder 24, in other embodiments, the blade 26 may be permanently affixed to the blade holder 24 (i.e., not intended to be detached and removed from the blade holder 24). As an example, in some embodiments, as shown in FIGS. 30 and 31, the blade holder 24 may retain the blade 26 using an adhesive 226 and/or one or more fasteners 228. For instance, in some embodiments, as shown in FIG. 30, the recess 190 of the blade holder 24 may receive the upper part of the blade 26 that is retained by the adhesive 226. The adhesive 226 may be an epoxy-based adhesive, a polyurethane-based adhesive, or any suitable adhesive. In some embodiments, instead of or in addition to using an adhesive, as shown in FIG. 31, the recess 190 of the blade holder 24 may receive the upper part of the blade 26 that is retained by the one or more fasteners 228. Each fastener 228 may be a rivet, a screw, a bolt, or any other suitable mechanical fastener. Alternatively or additionally, in some embodiments, as shown in FIG. 32, the blade-retention portion 188 of the blade holder 24 may extend into a recess 230 of the upper part of the blade 26 to retain the blade 26 using the adhesive 226 and/or the one or more fasteners 228. For instance, in some cases, the blade-retention portion 188 of the blade holder 24 may comprise a projection 232 extending into the recess 230 of the blade 26. As another example, in some embodiments, as shown in FIG. 33, the blade 26 and the blade-retaining base 164 of the blade holder 24 may be mechanically interlocked via an interlocking portion 234 of one of the blade-retaining base 164 and the blade 26 that extends into an interlocking void 236 of the other one of the blade-retaining base 164 and the blade 26. For instance, in some cases, the blade 26 can be positioned in a mold used for molding the blade holder 24 such that, during molding, the interlocking portion 234 of the blade-retaining base 164 flows into the interlocking void 236 of the blade 26 (i.e., the blade holder 24 is overmolded onto the blade 26).

Figure 34:
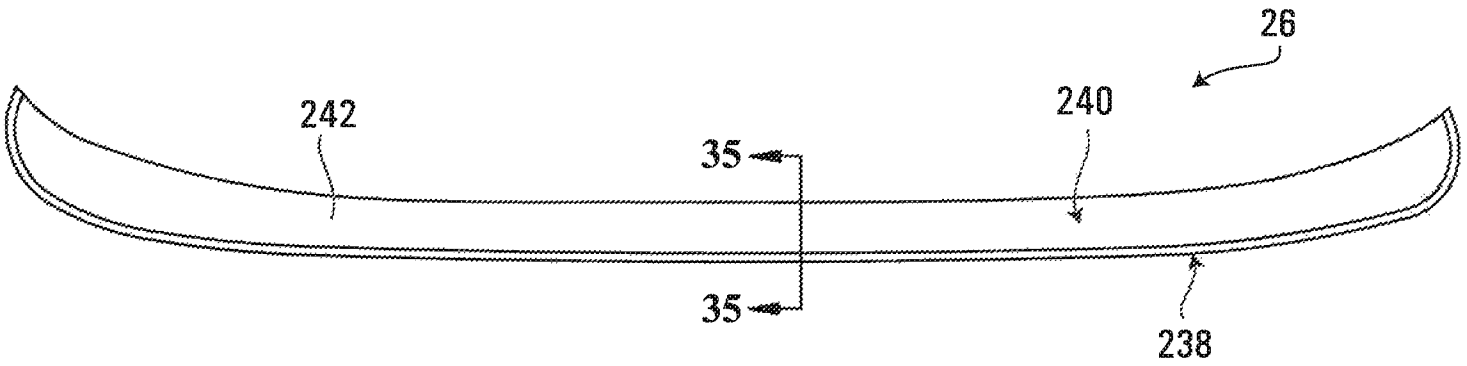
FIGS. 34 and 35 show a side view and front view of the blade in accordance with a variant in which in the blade comprises a runner and a body.
Figure 35:
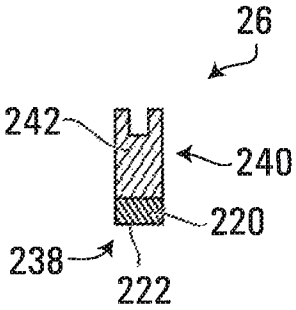

The blade 26 may be implemented in any other suitable way in other embodiments. For example, in some embodiments, as shown in FIGS. 34 and 35, the blade 26 may comprise a runner 238 that is made of the ice-contacting material 220 and includes the ice-contacting surface 222 and a body 240 connected to the runner 238 and made of a material 242 different from the ice-contacting material 220. The runner 238 and the body 240 of the blade 26 may be retained together in any suitable way. For example, in some cases, the runner 238 may be adhesively bonded to the body 240 using an adhesive. As another example, in addition to or instead of being adhesively bonded, the runner 238 and the body 240 may be fastened using one or more fasteners (e.g., rivets, screws, bolts, etc.). As yet another example, the runner 238 and the body 240 may be mechanically interlocked by an interlocking portion of one of the runner 238 and the body 240 that extends into an interlocking space (e.g., one or more holes, one or more recesses, and/or one or more other hollow areas) of the other one of the runner 238 and the body 240 (e.g., the body 240 may be overmolded onto the runner 238).

In other embodiments, the outer shell 30 of the skate boot 22 may be configured in various other ways such that a given part of the outer shell 30 that is more likely to be impacted by a puck during play may be more protective than another part of the outer shell 30 that is less likely to be impacted by a puck during play. For example, in some embodiments, the lateral side portion 68 of the outer shell 30 may be more likely to be impacted during play than other portions of the outer shell 30 and may therefore be stiffer or otherwise provide better protection. For instance, in some embodiments, a stiffness of the lateral side portion 68 of the outer shell 30 may be greater than a stiffness of the medial side portion 66 of the outer shell 30 such that a ratio of the stiffness of the lateral side portion 68 of the outer shell 30 over the stiffness of the medial side portion 66 of the outer shell 30 may be, in some cases, at least a 1.1, in some cases at least 1.2, in some cases at least 1.3, in some cases at least 1.4, in some cases at least 1.5, in some cases at least 2 and in some cases even more.

In some embodiments, a given part of the outer shell 30 that is more likely to be impact by a puck during play may have a hardness or an impact resistance that is greater than another part of the outer shell 30 that is less likely to be impacted by a puck during play. For instance, a hardness of the lateral side portion 68 of the outer shell 30 may be greater than a hardness of the medial side portion 66 of the outer shell 30 or an impact resistance of the lateral side portion 68 of the outer shell 30 may be greater than an impact resistance of the medial side portion 66 of the outer shell 30.

Figure 36:
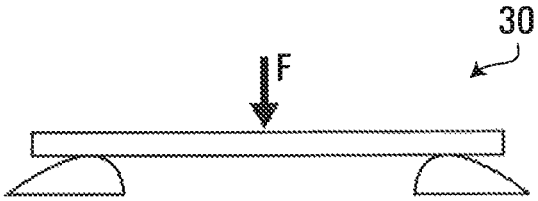
FIG. 36 shows a three-point bending test being performed on a part of the outer shell of the skate boot to determine a stiffness of the outer shell.

To observe the stiffness of a part of the outer shell 30, as shown in FIG. 36, the part of the outer shell 30 can be isolated from the remainder of the outer shell 30 (e.g., by cutting, or otherwise removing the part from the outer shell 30, or by producing the part without the remainder of the outer shell 30) and a three-point bending test can be performed on the part to subject it to loading tending to bend the part in specified ways (along a defined direction of the part if the part is anisotropic) to observe the rigidity of the part and measure parameters indicative of the rigidity of the part. For instance in some embodiments, the three-point bending test may be based on conditions defined in a standard test (e.g., ISO 178(2010)).

For example, to observe the rigidity of the outer shell 30, the three-point bending test may be performed to subject the outer shell 30 to loading tending to bend the outer shell 30 until a predetermined deflection of the outer shell 30 is reached and measure a bending load at that predetermined deflection of the outer shell 30. The predetermined deflection of the outer shell 30 may be selected such as to correspond to a predetermined strain of the outer shell 30 at a specified point of the outer shell 30 (e.g., a point of the inner surface of the outer shell 30). For instance, in some embodiments, the predetermined strain of the outer shell 30 may between 3% and 5%. The bending load at the predetermined deflection of the outer shell 30 may be used to calculate a bending stress at the specified point of the outer shell 30. The bending stress at the specified point of the outer shell 30 may be calculated as $\sigma = My/I$, where M is the moment about a neutral axis of the outer shell 30 caused by the bending load, y is the perpendicular distance from the specified point of the outer shell 30 to the neutral axis of the outer shell 30, and I is the second moment of area about the neutral axis of the outer shell 30. The rigidity of the outer shell 30 can be taken as the bending stress at the predetermined strain (i.e., at the predetermined deflection) of the outer shell 30. Alternatively, the rigidity of the outer shell 30 may be taken as the bending load at the predetermined deflection of the outer shell 30. Any other suitable test may be used in other embodiments (e.g., a charmin test or a forward flex test).

To provide a part of the outer shell 30 with more stiffness than another part of the outer shell 30, the modulus of elasticity of certain parts of the outer shell 30 may vary. For instance, in some cases, the modulus of elasticity of a given one of the heel portion 62, the ankle portion 64, the medial side portion 66 and the lateral side portion 68 of the outer shell 30 may be greater than the modulus of elasticity of another one of the heel portion 62, the ankle portion 64, the medial side portion 66 and the lateral side portion 68 of the outer shell 30. For instance, in some examples of implementation, the modulus of elasticity of the lateral side portion 68 of the outer shell 30 may be greater than the modulus of elasticity of the medial side portion 66 of the outer shell 30. In some examples of implementation, the modulus of elasticity of the heel portion 62 of the outer shell 30 may be greater than the modulus of elasticity of the medial side portion 68 of the outer shell 30. This may provide additional reinforcement at the lateral side portion 68 and/or the heel portion 62 of the outer shell 30 where impact by a puck may be more likely to occur during play.

Figure 37:
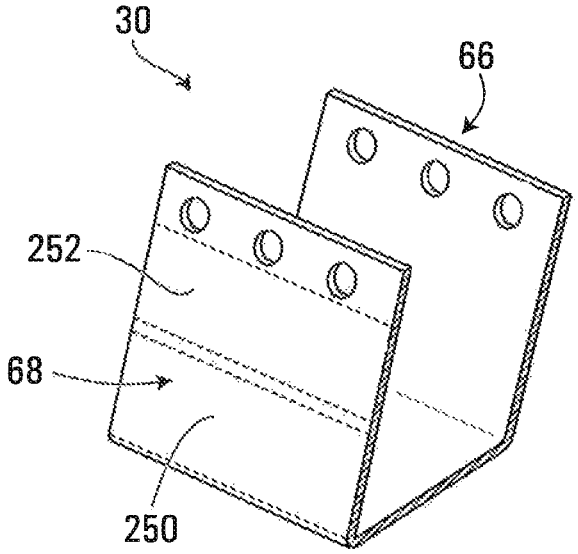
FIG. 37 shows a perspective view of a portion of the outer shell, including its lateral and medial side portions, in accordance with a variant in which a first area of the lateral side portion is stiffer than a second area of the lateral side portion.
Figure 38:
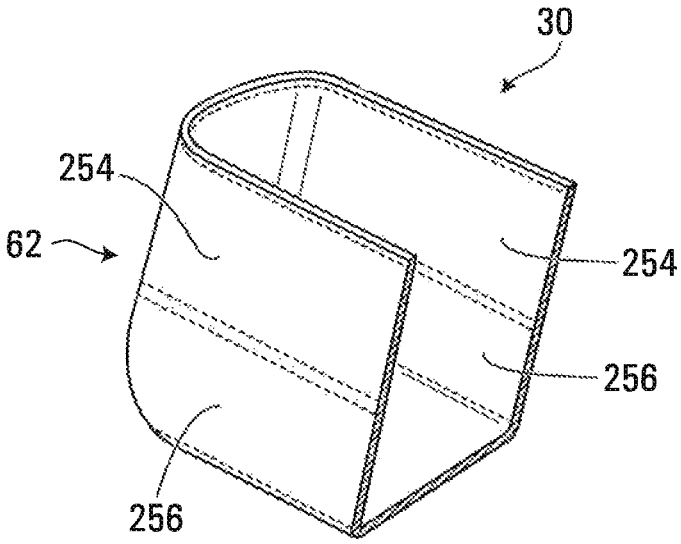
FIG. 38 shows a perspective view of a heel portion of the outer shell in accordance with a variant in which a first area of the heel portion is stiffer than a second area of the heel portion.

In some cases, the modulus of elasticity of a given one of the heel portion 62, the ankle portion 64, the medial side portion 66 and the lateral side portion 68 of the outer shell 30 may vary. For instance, in some examples of implementation, as shown in FIG. 37, the modulus of elasticity of a first area 250 of the lateral side portion 68 of the outer shell 30 may be greater than the modulus of elasticity of a second area 252 of the lateral side portion 68 of the outer shell 30. For example, a ratio of the modulus of elasticity of the first area 250 of the lateral side portion 68 over the modulus of elasticity of the second area 252 of the lateral side portion 68 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more. In this example, the first area 250 is lower than the second area 252 in the height-wise direction of the skate $\mathbf{10}_x$. For example, the first area 250 may be part of the bottom region 84 of the lateral side portion 68. In another example of implementation, as shown in FIG. 38, the modulus of elasticity of a first area 254 of the heel portion 62 of the outer shell 30 may be greater than the modulus of elasticity of a second area 256 of the heel portion 62 of the outer shell 30. For example, a ratio of the modulus of elasticity of the first area 254 of the heel portion 62 over the modulus of elasticity of the second area 256 of the heel portion 62 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more. In this example, the first area 254 is lower than the second area 256 in the height-wise direction of the skate $\mathbf{10}_x$. For example, the first area 254 may be part of the bottom region 88 of the heel portion 62.

In some cases, a given one of the heel portion 62, the ankle portion 64, the medial side portion 66 and the lateral side portion 68 of the outer shell 30 may be configured to be thicker than another one of the heel portion 62, the ankle portion 64, the medial side portion 66 and the lateral side portion 68 of the outer shell 30. For example, a ratio of a thickness of the lateral side portion 68 over a thickness of the medial side portion 66 may be at least 1.2, in some cases at least 1.4, in some cases at least 1.6, in some cases at least 1.8, in some cases at least 2, and in some cases even more.

In another variant, the toe cap 32 of the skate boot 22 may be configured such that a first part of the toe cap 32 that is more likely to be impacted by a puck during play may be more protective (e.g., stiffer) than a second part of the toe cap 32 that is less likely to be impacted by a puck during play.

For instance, a given one of the lateral side portion 118, the medial side portion 120, the end portion 122 and the upper portion 124 of the toe cap 32 may be configured to be stiffer than another one of the lateral side portion 118, the medial side portion 120, the end portion 122 and the upper portion 124 of the toe cap 32. For example, a ratio of a stiffness of the lateral side portion 118 of the toe cap 32 over a stiffness of the medial side portion 120 of the toe cap 32 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more.

To provide a part of the toe cap 32 with more stiffness than another part of the toe cap 32, the modulus of elasticity of certain parts of the toe cap 32 may vary. For instance, in some cases, the modulus of elasticity of a given one of the lateral side portion 118, the medial side portion 120, the end portion 122 and the upper portion 124 of the toe cap 32 may be greater than the modulus of elasticity of another one of the lateral side portion 118, the medial side portion 120, the end portion 122 and the upper portion 124 of the toe cap 32. For instance, in some examples of implementation, the modulus of elasticity of the lateral side portion 118 of the toe cap 32 may be greater than the modulus of elasticity of the medial side portion 120 of the toe cap 32. In some examples of implementation, the modulus of elasticity of the end portion 122 of the toe cap 32 may be greater than the modulus of elasticity of the medial side portion 120 of the toe cap 32. This may provide additional reinforcement at the lateral side portion 118 and/or the end portion 122 of the toe cap 32 where impact by a puck may be more likely to occur during play.

Figure 39:
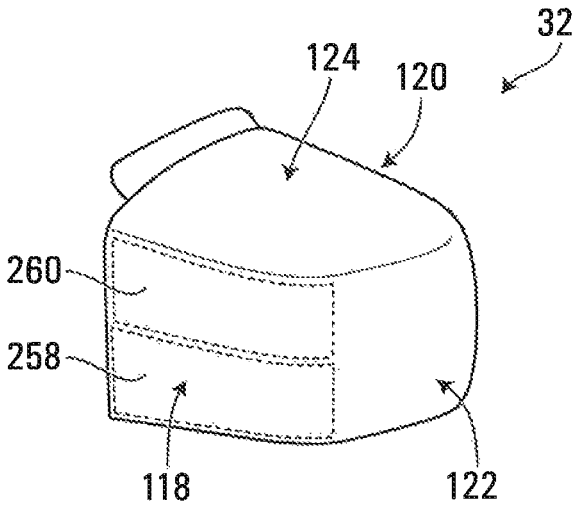
FIG. 39 shows a perspective view of the toe cap in accordance with a variant in which a first area of a lateral side portion of the toe cap is stiffer than a second area of the lateral side portion of the toe cap.

In some cases, the modulus of elasticity of a given one of the lateral side portion 118, the medial side portion 120, the end portion 122 and the upper portion 124 of the toe cap 32 may vary. For instance, in one example of implementation, as shown in FIG. 39, the modulus of elasticity of a first area 258 of the lateral side portion 118 of the toe cap 32 may be greater than the modulus of elasticity of a second area 260 of the lateral side portion 118 of the toe cap 32. For example, a ratio of the modulus of elasticity of the first area 258 of the lateral side portion 118 over the modulus of elasticity of the second area 260 of the lateral side portion 118 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more. In this example, the first area 258 is lower than the second area 260 in the height-wise direction of the skate $\mathbf{10}_x$. For example, the first area 258 may be part of the bottom region 90 of the toe cap 32.

Figure 40:
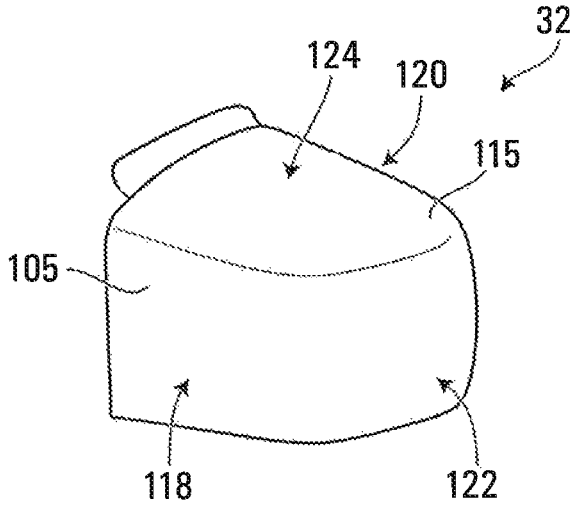
FIG. 40 shows a perspective view of the toe cap in accordance with a variant in which the toe cap comprises a first synthetic material and a second synthetic material.

To implement different stiffnesses at different parts of the toe cap 32, the toe cap 32 may comprise a plurality of materials having different properties. For example, with additional reference to FIG. 40, the toe cap 32 may comprise a second synthetic material 115 different from the first synthetic material 105 of the toe cap 32. The second synthetic material 115 of the toe cap 32 may be stiffer than the first synthetic material 105 of the toe cap 32. For example, a ratio of the modulus of elasticity of the second synthetic material 115 of the toe cap 32 over the modulus of elasticity of the first synthetic material 105 of the toe cap 32 may be, in some cases, at least 1.1, in some cases at least 1.2, in some cases at least 1.3, in some cases at least 1.4, in some cases at least 1.5, in some cases at least 1.6, in some cases at least 1.7, in some cases at least 1.8, in some cases at least 1.9, in some cases at least 2 and in some cases even more.

Figure 41:
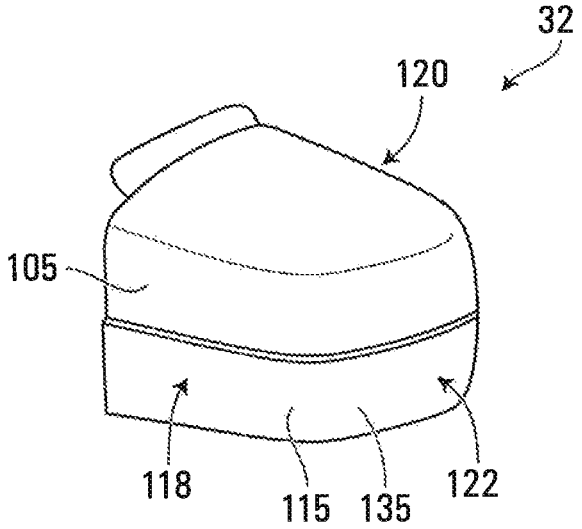
FIG. 41 shows a perspective view of the toe cap in accordance with a variant in which the toe cap comprises an overlay comprising the second synthetic material.

In one example of implementation, with additional reference to FIG. 41, an overlay 135 comprising the second synthetic material 115 of the toe cap 32 may be disposed over the first synthetic material 105 of the toe cap 32. For instance, the second synthetic material 115 of the toe cap 32 may be bonded to the first synthetic material 105 of the toe cap 32 in any suitable way. For example, the second synthetic material 115 of the toe cap 32 may be adhesively bonded, stitched, welded (e.g., ultrasonically welded) or overmolded onto the first synthetic material 105 of the toe cap 32.

In another example of implementation, in order to make a part of the toe cap 32 stiffer, the toe cap 32 may be configured such that its thickness $T_C$ varies. For example, a given one of the lateral side portion 118, the medial side portion 120, the end portion 122 and the upper portion 124 of the toe cap 32 may have a thickness that is greater than a thickness of another one of the lateral side portion 118, the medial side portion 120, the end portion 122 and the upper portion 124 of the toe cap 32. This may impart reinforcement at selected portion(s) of the toe cap 32 that are more likely to be impacted during play.

In one example of implementation, the bottom region 90 of the toe cap 32 may have a thickness that is greater than a remainder of the toe cap 90. As another example, a thickness of the lateral side portion 118 of the toe cap 32 may be greater than a thickness of the medial side portion 120 of the toe cap 32. In some cases, a thickness of the end portion 122 of the toe cap 32 may be greater than the thickness of the medial side portion 120 of the toe cap 32. The thickness of the toe cap 32 may vary in any other suitable way.

Figure 20:
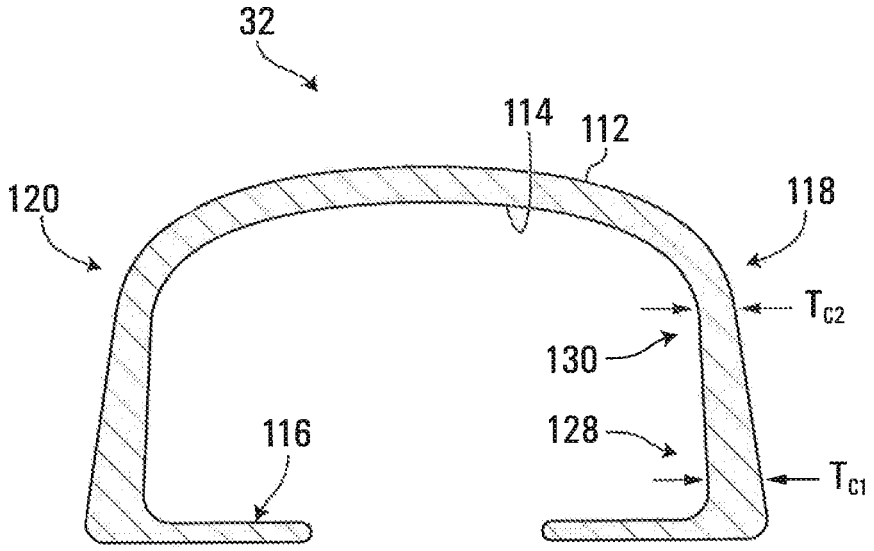
FIG. 20 shows a cross-sectional view of the toe cap where the toe cap comprises areas of increased thickness.
Figure 21:
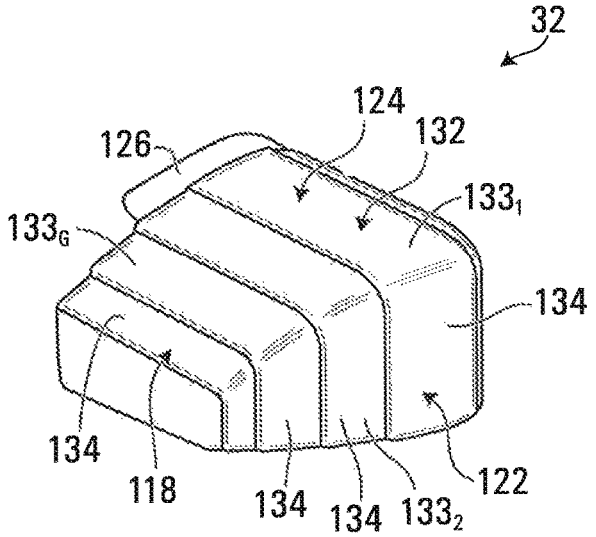
FIGS. 21 to 23 show a reinforcement of the toe cap in accordance with various embodiments.

Furthermore, in some embodiments, the thickness of a given one of the lateral side portion 118, the medial side portion 120, the end portion 122 and the upper portion 124 of the toe cap 32 may vary. For instance, as shown in FIG. 20, a thickness $T_{C1}$ of a first area 128 of the lateral side portion 118 may be greater than a thickness $T_{C2}$ of a second area 130 of the lateral side portion 118. A ratio of the thickness $T_{C1}$ of the first area 128 over the thickness $T_{C2}$ of the second area 130 may be at least 1.1, in some cases at least 1.2, in some cases at least 1.3, and in some cases even more. In this example, the first area 128 is lower than the second area 130 in the height-wise direction of the skate $\mathbf{10}_x$ such that a lower area of the lateral side portion 118 is thicker than an upper area of the lateral side portion 118.

In one example of implementation, the different thicknesses at different parts of the toe cap 32 may be provided through the second synthetic material 115 of the toe cap 32 when it is used as an overlay that is disposed over the first synthetic material 105 of the toe cap 32. For instance, the second synthetic material 115 of the toe cap 32 may have a thickness different from a thickness of the first synthetic material 105 of the toe cap 32. For example, the thickness of the second synthetic material 115 of the toe cap 32 may be less than the thickness of the first synthetic material 105 of the toe cap 32.

Although in embodiments considered above the skate $10_x$ is designed for playing ice hockey on the playing surface 12 which is ice, in other embodiments, the skate $10_x$ may be constructed using principles described herein for playing roller hockey or another type of hockey (e.g., field or street hockey) on the playing surface 12 which is a dry playing surface (e.g., a polymeric, concrete, wooden, or turf playing surface or any other dry playing surface on which roller hockey or field or street hockey is played). Thus, in other embodiments, instead of comprising a skating device that comprises the blade 26, the skate $10_x$ may comprise a skating device that comprises a set of wheels to roll on the dry playing surface 12.

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

To facilitate the description, any reference numeral designating an element in one figure designates the same element if used in any other figures. In describing the embodiments, specific terminology has been resorted to for the sake of description but the invention is not intended to be limited to the specific terms so selected, and it is understood that each specific term comprises all equivalents.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A skate for a hockey goalkeeper, the skate comprising:
a skate boot for receiving a foot of the hockey goalkeeper;
a blade for contacting ice; and
a blade holder between the skate boot and the blade;
the skate boot comprising:
an outer shell;
a toe cap defining a frontmost surface of the skate above the blade holder for facing toes of the foot of the hockey goalkeeper, the toe cap being distinct from the outer shell; and
a tongue connected to the toe cap and defining a highest point of the skate boot;
wherein the skate is devoid of any cowling covering the toe cap;
wherein the toe cap comprises a first synthetic material and a second synthetic material of different stiffnesses; and
wherein the first synthetic material covers an area of the toe cap that is free of the second synthetic material.

2. The goalie skate of claim 1, wherein the first synthetic material comprises at least one of high density polyethylene, nylon, polycarbonate, polypropylene, polyurethane, and acrylonitrile butadiene styrene.

3. The goalie skate of claim 1, wherein the second synthetic material of the toe cap is stiffer than the first synthetic material of the toe cap.

4. The goalie skate of claim 1, wherein a ratio of a modulus of elasticity of the second synthetic material of the toe cap over a modulus of elasticity of the first synthetic material of the toe cap is at least 1.1.

5. The goalie skate of claim 1, wherein the second synthetic material of the toe cap is bonded to the first synthetic material of the toe cap.

6. The goalie skate of claim 5, wherein the second synthetic material of the toe cap is adhesively bonded to the first synthetic material of the toe cap.

7. The goalie skate of claim 1, wherein the second synthetic material of the toe cap is overmolded onto the first synthetic material of the toe cap.

8. The goalie skate of claim 1, wherein a thickness of the second synthetic material of the toe cap is different from a thickness of the first synthetic material of the toe cap.

9. The goalie skate of claim 8, wherein the thickness of the second synthetic material of the toe cap is less than the thickness of the first synthetic material of the toe cap.

10. The goalie skate of claim 1, wherein the toe cap comprises a first layer comprising the first synthetic material and a second layer comprising the second synthetic material, the second layer being disposed over the first layer and defining a reinforced portion of the toe cap that is likely to be impacted by a puck during play.

11. The goalie skate of claim 1, wherein: the toe cap comprises a first portion and a second portion configured to face different parts of the foot of the hockey goalkeeper; a thickness of the first portion of the toe cap is greater than a thickness of the second portion of the toe cap; and the area of the toe cap is part of the second portion.

12. A skate for a hockey goalkeeper, the skate comprising:
a skate boot for receiving a foot of the hockey goalkeeper;
a blade for contacting ice; and
a blade holder between the skate boot and the blade;
the skate boot comprising:
an outer shell;
a toe cap defining a frontmost surface of the skate above the blade holder for facing toes of the foot of the hockey goalkeeper, the toe cap being distinct from the outer shell; and
a tongue connected to the toe cap and defining a highest point of the skate boot;
wherein the skate is devoid of any cowling covering the toe cap;
wherein the toe cap comprises a first part and a second part configured to face different parts of the foot of the hockey goalkeeper, the first part being more likely to be impacted by a puck during play than the second part, the first part being reinforced such that the first part is structurally stiffer than the second part.

13. A skate for a hockey goalkeeper, the skate comprising:
a skate boot for receiving a foot of the hockey goalkeeper;
a blade for contacting ice; and
a blade holder between the skate boot and the blade;
the skate boot comprising:
an outer shell;
a toe cap defining a frontmost surface of the skate above the blade holder for facing toes of the foot of the hockey goalkeeper; and
a tongue connected to the toe cap and defining a highest point of the skate boot;
wherein the skate is devoid of any cowling covering the toe cap;
wherein the toe cap comprises a first portion and a second portion configured to face different parts of the foot of the hockey goalkeeper;
wherein the first portion is reinforced for protecting the goalkeeper from pucks during play;

wherein a thickness of the first portion of the toe cap is greater than a thickness of the second portion of the toe cap; and wherein the toe cap comprises (i) a body made of a first synthetic material and (ii) an overlay affixed to an outer surface of the body and defining the first portion, the overlay comprising a second synthetic material, the first synthetic material and the second synthetic material having different stiffnesses.

14. The goalie skate of claim 13, wherein the first synthetic material comprises at least one of high density polyethylene, nylon, polycarbonate, polypropylene, polyurethane, and acrylonitrile butadiene styrene.

15. The goalie skate of claim 13, wherein the second synthetic material of the toe cap is stiffer than the first synthetic material of the toe cap.

16. The goalie skate of claim 13, wherein a ratio of a modulus of elasticity of the second synthetic material of the toe cap over a modulus of elasticity of the first synthetic material of the toe cap is at least 1.1.

17. The goalie skate of claim 13, wherein the second synthetic material of the toe cap is bonded to the first synthetic material of the toe cap.

18. The goalie skate of claim 17, wherein the second synthetic material of the toe cap is adhesively bonded to the first synthetic material of the toe cap.

19. The goalie skate of claim 13, wherein the second synthetic material of the toe cap is overmolded onto the first synthetic material of the toe cap.

20. The goalie skate of claim 13, wherein a thickness of the second synthetic material of the toe cap is different from a thickness of the first synthetic material of the toe cap.

21. The goalie skate of claim 20, wherein the thickness of the second synthetic material of the toe cap is less than the thickness of the first synthetic material of the toe cap.

22. The goalie skate of claim 13, wherein: the toe cap comprises a lateral side portion for facing a small toe of the foot, a medial side portion for facing a big toe of the foot, an end portion between the lateral and medial side portions, and an upper portion for facing a top of the toes of the foot; and each of the first portion and the second portion of the toe cap is a different one of the lateral side portion, the medial side portion, the end portion and the upper portion of the toe cap.

23. The goalie skate of claim 13, wherein: the toe cap comprises a lateral side portion for facing a small toe of the foot, a medial side portion for facing a big toe of the foot, an end portion between the lateral and medial side portions, and an upper portion for facing a top of the toes of the foot; and the first portion and the second portion of the toe cap are part of a single one of the lateral side portion, the medial side portion, the end portion and the upper portion of the toe cap.

24. The goalie skate of claim 13, wherein a ratio of the thickness of the first portion of the toe cap over the thickness of the second portion of the toe cap is at least 1.2.

* * * * *